US008025359B2

(12) United States Patent
Yano

(10) Patent No.: US 8,025,359 B2
(45) Date of Patent: Sep. 27, 2011

(54) PROTECTOR FOR INK CARTRIDGE CONTAINER

(75) Inventor: Hiroyasu Yano, Midori-ku (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1050 days.

(21) Appl. No.: 11/693,071

(22) Filed: Mar. 29, 2007

(65) Prior Publication Data

US 2007/0229631 A1 Oct. 4, 2007

(30) Foreign Application Priority Data

Mar. 31, 2006 (JP) ..... 2006-100496

(51) Int. Cl.
*B41J 2/165* (2006.01)

(52) U.S. Cl. ..... 347/29; 347/22; 347/87

(58) Field of Classification Search ..... 347/22, 347/29, 87

See application file for complete search history.

(56) References Cited

U.S. PATENT DOCUMENTS

| | | | | |
|---|---|---|---|---|
| 4,045,802 | A * | 8/1977 | Fukazawa et al. | 347/29 |
| 5,867,184 | A * | 2/1999 | Quintana | 347/29 |
| 5,956,053 | A * | 9/1999 | Michael | 347/29 |
| 6,132,036 | A | 10/2000 | Abe et al. | |
| 6,241,336 | B1 * | 6/2001 | Muraki | 347/32 |
| 6,827,417 | B2 * | 12/2004 | Seino | 347/19 |
| 6,945,643 | B2 | 9/2005 | Tajima et al. | |
| 7,044,588 | B2 | 5/2006 | Tajima et al. | |
| 7,121,644 | B2 | 10/2006 | Ueda et al. | |
| 2005/0185237 | A1 | 8/2005 | Nakajima | |
| 2007/0229620 | A1 | 10/2007 | Yano | |

FOREIGN PATENT DOCUMENTS

| | | | |
|---|---|---|---|
| EP | 1602487 | A1 | 7/2005 |
| JP | H8-112915 | A | 5/1996 |
| JP | H11-157094 | A | 6/1996 |
| JP | H09-076525 | A | 3/1997 |
| JP | H10-272786 | A | 10/1998 |
| JP | 2002079690 | A | 3/2002 |
| JP | 2002321387 | A | 11/2002 |

(Continued)

OTHER PUBLICATIONS

Japan Patent Office; Notification of Reasons for Refusal in Japanese Patent Application No. 2006-100496 (counterpart to the above-captioned U.S. patent application) mailed Jan. 20, 2010.

*Primary Examiner* — Ryan Lepisto
*Assistant Examiner* — Guy G Anderson
(74) *Attorney, Agent, or Firm* — Baker Botts L.L.P.

(57) ABSTRACT

A protector for an ink cartridge container including a containing case body, an ink inlet for a recording head, a cartridge containing part into which an ink cartridge is removably insertable, and a door body capable of opening and closing an opening opposed to the ink inlet with the cartridge containing part sandwiched therebetween, the protector includes a protective cap unit including: a main body; a supporting rod protruded toward the ink inlet from the main body; a guiding funnel formed at a front edge of the supporting rod; and an elastic cap provided at an inner diametrical portion of the guiding funnel and capable of coming into close contact with the ink inlet, wherein: the protective cap unit is removable from and insertable into a containing case body; and the protective cap unit is formed as a different shape than that of the ink cartridge.

8 Claims, 16 Drawing Sheets

FOREIGN PATENT DOCUMENTS

| | | | |
|---|---|---|---|
| JP | 2003054000 | A | 2/2003 |
| JP | 2004-017446 | A | 1/2004 |
| JP | 2004230857 | A | 8/2004 |
| JP | 2005014368 | A | 1/2005 |
| JP | 2005-238857 | A | 9/2005 |
| JP | 2005238857 | A | 9/2005 |
| JP | 2005345866 | A | 12/2005 |

* cited by examiner

PROTECTOR FOR INK CARTRIDGE CONTAINER

CROSS-REFERENCE TO THE RELATED APPLICATION(S)

This application is based upon and claims priority from prior Japanese Patent Application No. 2006-100496 filed on Mar. 31, 2006, the entire content of which is incorporated herein by reference.

TECHNICAL FIELD

Aspects of the present invention relate to a structure of a protector for an ink cartridge container (e.g. refill unit) provided in an ink-jet recording device (e.g. ink-jet printer).

BACKGROUND

Generally, an ink-jet recording device includes a recording head provided in a carriage. The carriage reciprocatingly moves in a direction (main scanning direction) intersecting with or perpendicular to a recording medium (e.g. recording sheet) to be conveyed. The recording head ejects drops of ink, thereby recording an image on the recording medium. The ink is stored in advance in a cartridge type ink tank (e.g. ink cartridge), and is supplied from the ink cartridge to the recording head.

Generally, ink cartridges are divided broadly into so-called on-carriage types and off-carriage types depending on the arrangement.

The on-carriage type is one in which a case for removably containing an ink cartridge is provided over a carriage movable as described above, and the ink cartridge accommodated and held within the case supplies ink to a recording head.

The off-carriage type is one in which a case is provided somewhere in a housing of an ink-jet recording device except in a position over a carriage, and an ink cartridge is accommodated and held within the case. Ink is supplied from the case to a recording head through an ink supply pipe.

Normally, one of the above-described types is necessary for replacing an ink cartridge with a new one when the remaining amount of stored ink is reduced.

In either of the on-carriage type device and the off-carriage type device, an ink cartridge is first set in a case in order to carry out a print test at a factory. A non-defective ink cartridge, which has been subjected to the test, is detached from the case to remove ink within a recording head, and the recording head is filled with a preservative solution having a property similar to that of ink except in colorant or pigment at the time of factory shipment. Alternatively, ink is allowed to remain within the recording head, and all ink inlets connected to the recording head are covered with a protective cap or a dummy cartridge, which has a shape similar to that of an ink cartridge (and in which no ink is stored), instead of the ink cartridge. According to the above, leakage of a preservative solution or ink (hereinafter, simply called "liquid") from the ink inlets is prevented. Further, a nozzle face of the recording head is protected by covering the nozzle face with a nozzle cap, as disclosed in JP-A-2002-79690, JP-A-2004-230857, JP-A-2005-238857 and JP-A-2003-54000.

The device is formed so that a lock lever or an engaging part for fixing the ink cartridge to the case is utilized. Thus, an improperly disengagement of the protective cap or dummy cartridge is prevented. Further, sealing property and hermetic property for the ink inlets is maintained.

SUMMARY

However, when a dummy cartridge for an ink-jet recording device, which discharges color ink in addition to black ink for multicolor image recording, is used so as to seal and hermetically close a plurality of ink inlets as disclosed in JP-A-2002-79690 and JP-A-2004-230857, a corresponding number of dummy cartridges have to be prepared. These preparations increase production cost. Moreover, it is necessary to perform an operation of positioning a dummy cartridge for each ink inlet and maintaining the position of each cartridge. Therefore, the operation involves considerable effort and time and increased production cost.

JP-A-2005-238857 and JP-A-2003-54000 disclose a system that uses sealing parts, instead of a dummy cartridge, for hermetically closing a plurality of ink inlets. The plurality of ink inlets are arranged at one side of a single protective cap. The protective cap is detachably attached to a case for containing an ink cartridge and is fixed thereto by a lock lever. The system presents the advantage that a plurality of ink inlets can be sealed at one time. However, since the main body of the protective cap is integrally molded so as to have a volume substantially similar to that of a plurality of ink cartridges, the overall protective cap is increased in size. Therefore, the system also increases production cost.

Aspects of the invention provide a protector for an ink cartridge container, which has a function of reliably covering an ink inlet during shipment, transportation and storage to prevent liquid leakage and drying of ink within an ink-jet recording device, and which reduces trouble in an operation of sealing a single or a plurality of ink inlets although the protector is reduced in size and weight.

According to an aspect of the invention, there is provided an protector for an ink cartridge container, the ink cartridge container including a containing case body, an ink inlet for a recording head, a cartridge containing part into which an ink cartridge connectable to and disconnectable from the ink inlet is removably insertable, and a door body capable of opening and closing an opening opposed to the ink inlet with the cartridge containing part sandwiched therebetween, the protector including a protective cap unit that closes the ink inlet, the protective cap unit including; a main body; a supporting rod protruded toward the ink inlet from the main body; a guiding funnel formed at a front edge of the supporting rod; and an elastic cap provided at an inner diametrical portion of the guiding funnel and capable of coming into close contact with the ink inlet, wherein the protective cap unit is removable from and insertable into a containing case body, and the protective cap unit is formed as a different shape than that of the ink cartridge.

DETAILED DESCRIPTION

Figure 1:
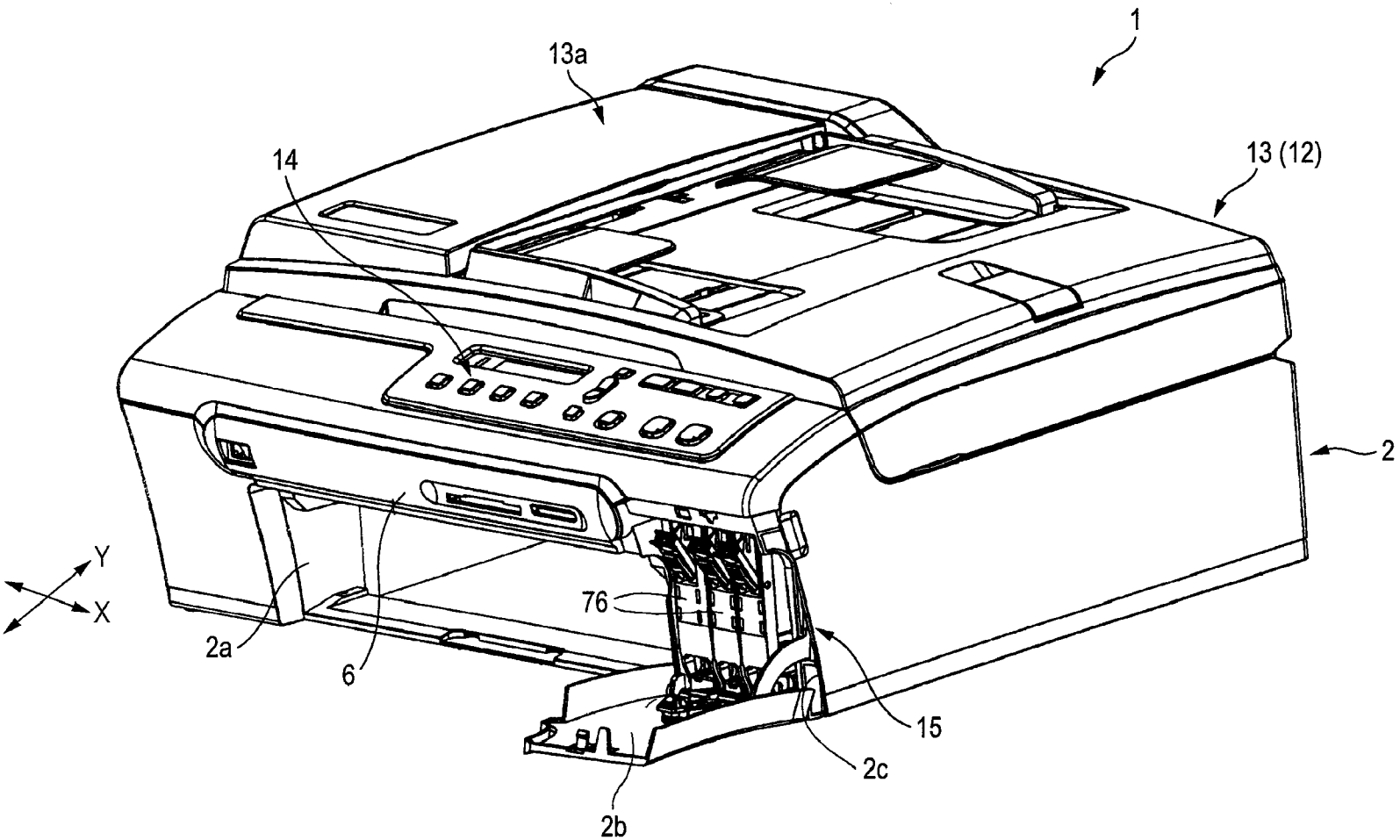
FIG. 1 is a perspective view of an appearance of a multifunction device according to an exemplary aspect of the present invention.

FIG. 1 is a perspective view of an appearance of a multifunction device according to an aspect of the present invention. The image recording device 1 is a multifunction device (MFD), which may include a printer function, a copy function, a scanner function and a facsimile function. The multifunction device can be connected to a computer (not shown), and the multifunction device records an image and a text on a recording sheet (recording medium) based on image data and text data transmitted from the computer. The multifunction device can also be connected to an external device such as a digital camera and can record image data outputted from the digital camera on a recording sheet.

As shown in FIG. 1, a device casing 2 made of synthetic resin is provided at its lower part with a printer section (recording section) 7. A sheet feeding cassette 3 is located in a cassette containing part (containing space) at a bottom of the device casing 2. The sheet feeding cassette 3 is insertable into and removable from an insertion port (opening) 2*a* opened at a front side of the device casing 2. The sheet feeding cassette 3 can be substantially horizontally put in and taken out from the insertion port 2*a*. Hereinafter, a part of the device casing 2 at which the insertion port 2*a* is located will be called "front side" or "front part." Right side, left side and rear side (back) are defined based on the front side. A slot 6 is provided with the front face of the device casing 2. Various storage media such as a memory card can be inserted into the slot 6, thereby enabling image data, for example, stored in the storage medium, to be recorded on a recording sheet.

An image reader (scanner section) 12 for document reading in a copy function and a facsimile function is located at an upper part of the device casing 2.

The upper side of the device casing 2 includes an operation panel 14 including various operation buttons and a liquid crystal display. The operation panel 14 is provided in front of the image reader 12. The recording section 7 and a sheet discharge section 10 are located in a plan view projected area of the image reader 12 and the operation panel 14. A cartridge container 15 is contained at one side of the sheet discharge section 10 (at the right side in FIG. 1) and a front part side of the device casing 2. A front face side of the cartridge container 15 is covered by a lid body 2*b*, which is opened and closed by being rotated upward and downward via a hinge at its lower end. The lid body 2*b* can be rotated between the position in which the lid body 2*b* inclines forward as shown in FIG. 1 to expose the cartridge container 15 from an opening 2*c* at the front face of the device casing 2, and the position in which the lid body 2*b* closes the opening 2*c* to cover the cartridge container 15.

Figure 3:
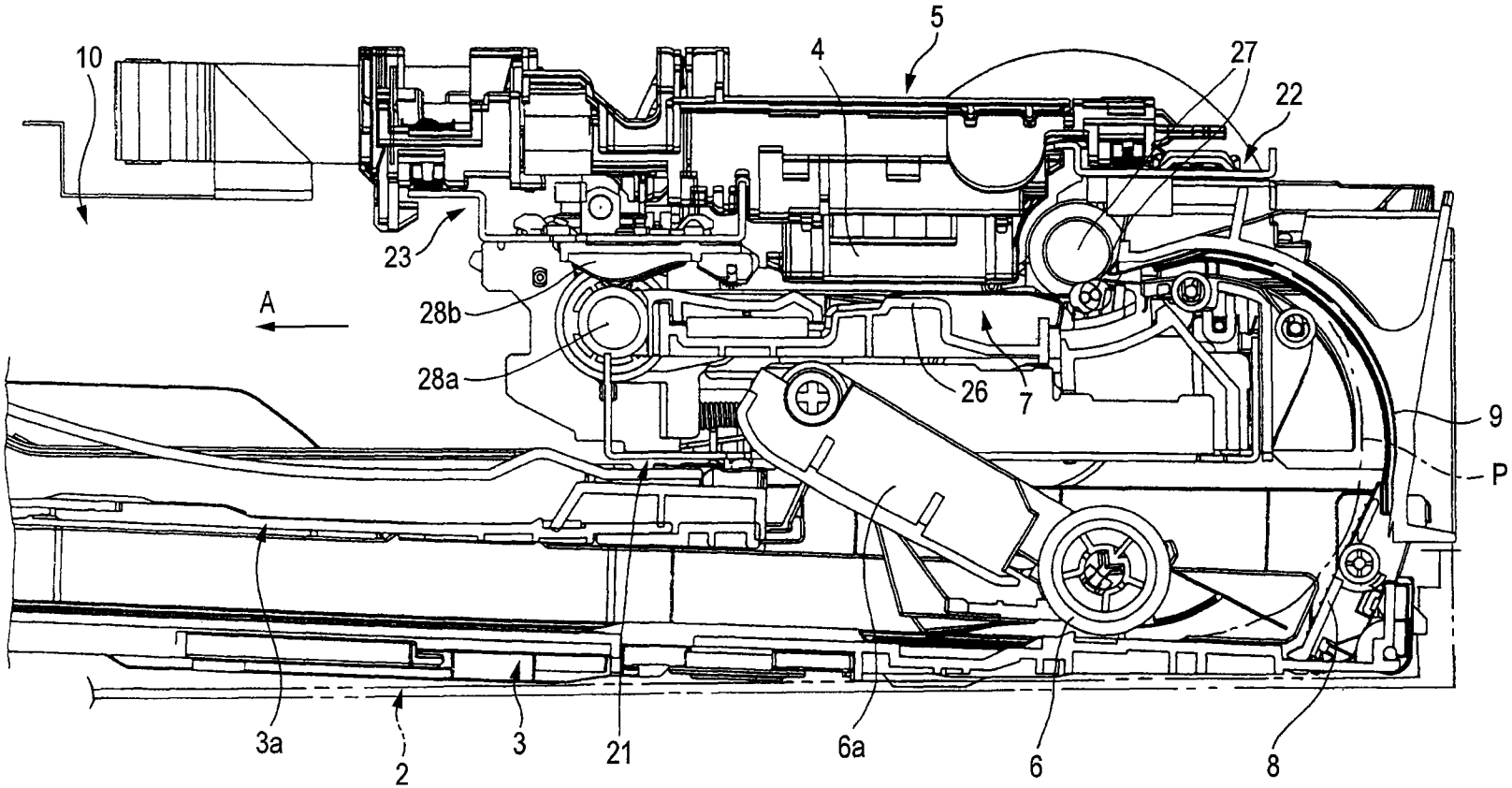
FIG. 3 is a sectional side view of a principal part of a recording section.

A glass plate (not shown) at which a document is placeable is provided at the upper face of the image reader 12. An image scanner for document reading as a contact image sensor (CIS) (not shown) is provided to be reciprocatingly movable along a direction perpendicular to a sheet face, as shown in FIG. 3. Hereinafter, a main scanning direction will be called "X-axis direction," and an axis extending in the main scanning direction will be called "X axis".

A document cover body 13 for covering the placeable glass plate includes an automatic document conveying mechanism as an auto document feeder (ADF) 13*a*. The document cover body 13 is attached so as to be opened and closed upward and downward via a hinge at its rear end. The rear end is related to the right back side of FIG. 1.

As shown in FIG. 3, the sheet feeding cassette 3 is formed to be able to contain a plurality of stacked and accumulated sheets P, each serving as a recording medium and cut into A4-size, letter-size, legal-size, postcard-size, or other printable sizes so that its short side extends in a direction, which corresponds to the main scanning direction and the X-axis direction. As shown in FIG. 1, the main scanning direction and the X-axis direction is a direction perpendicular to a sheet conveying direction, which corresponds to a sub-scanning direction. Hereinafter, the sub-scanning direction will be called "Y-axis direction."

An auxiliary cassette 3*a* for supplying a plurality of accumulated small-size sheets (not shown) is attached at an upper part of the sheet feeding cassette 3 so as to be movable in the Y-axis direction. In FIG. 1, the sheet feeding cassette 3 and the auxiliary cassette 3*a* are omitted.

At the back of the sheet feeding cassette 3 (i.e., at the right side in FIG. 3), an inclined separator 8 for separating sheets is located. On the other hand, at the device casing 2 side, an arm 6*a* whose upper end is rotatable upward and downward is attached. A sheet feeding roller 6 provided at a lower end of this arm 6*a* cooperates with the inclined separator 8, thus separately conveying the sheets P, which serve as recording media and accumulated in the sheet feeding cassette 3 and the auxiliary sheet feeding cassette 3*a*, one by one. The separated sheet P is fed to the recording section 7 provided behind and above (i.e., at a position higher than) the sheet feeding cassette 3 via a U-turn path (feeding path) 9 extending upwardly and horizontally. The recording section 7 includes, for example, a reciprocatingly movable carriage 5 equipped with an ink-jet recording head 4 for realizing a printer function and the like.

The sheet discharge section 10 for discharging the sheet P with an upwardly-facing recording surface, on which recording has been performed at the recording section 7, is formed above the auxiliary sheet feeding cassette 3*a*. As shown in FIG. 1, a sheet discharge port 10*a*, which is communicated with the sheet discharge section 10 and located above the insertion port 2*a*, is opened toward the front face of the device casing 2.

Figure 2:
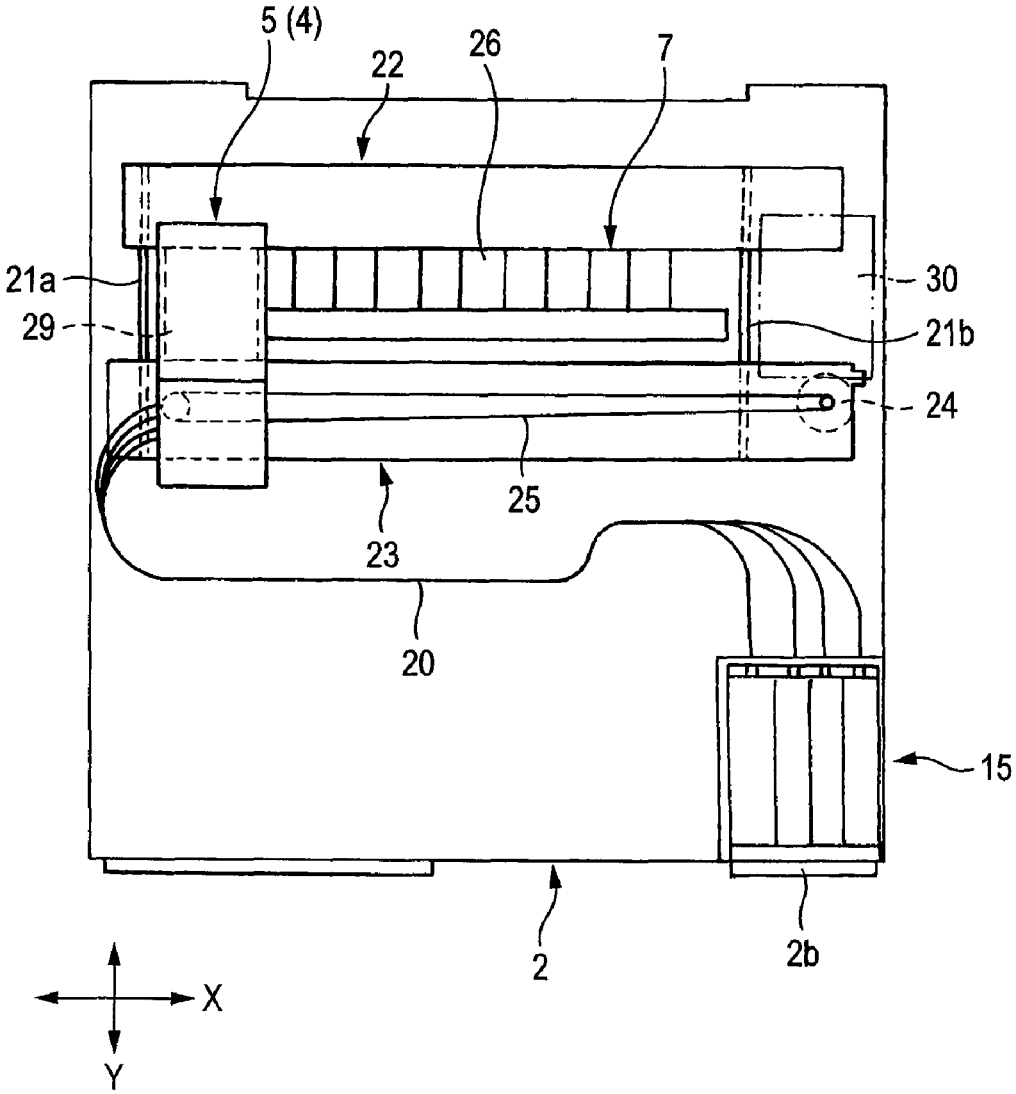
FIG. 2 is a plan view of a housing (body casing) from which an upper case is removed.
Figure 4:
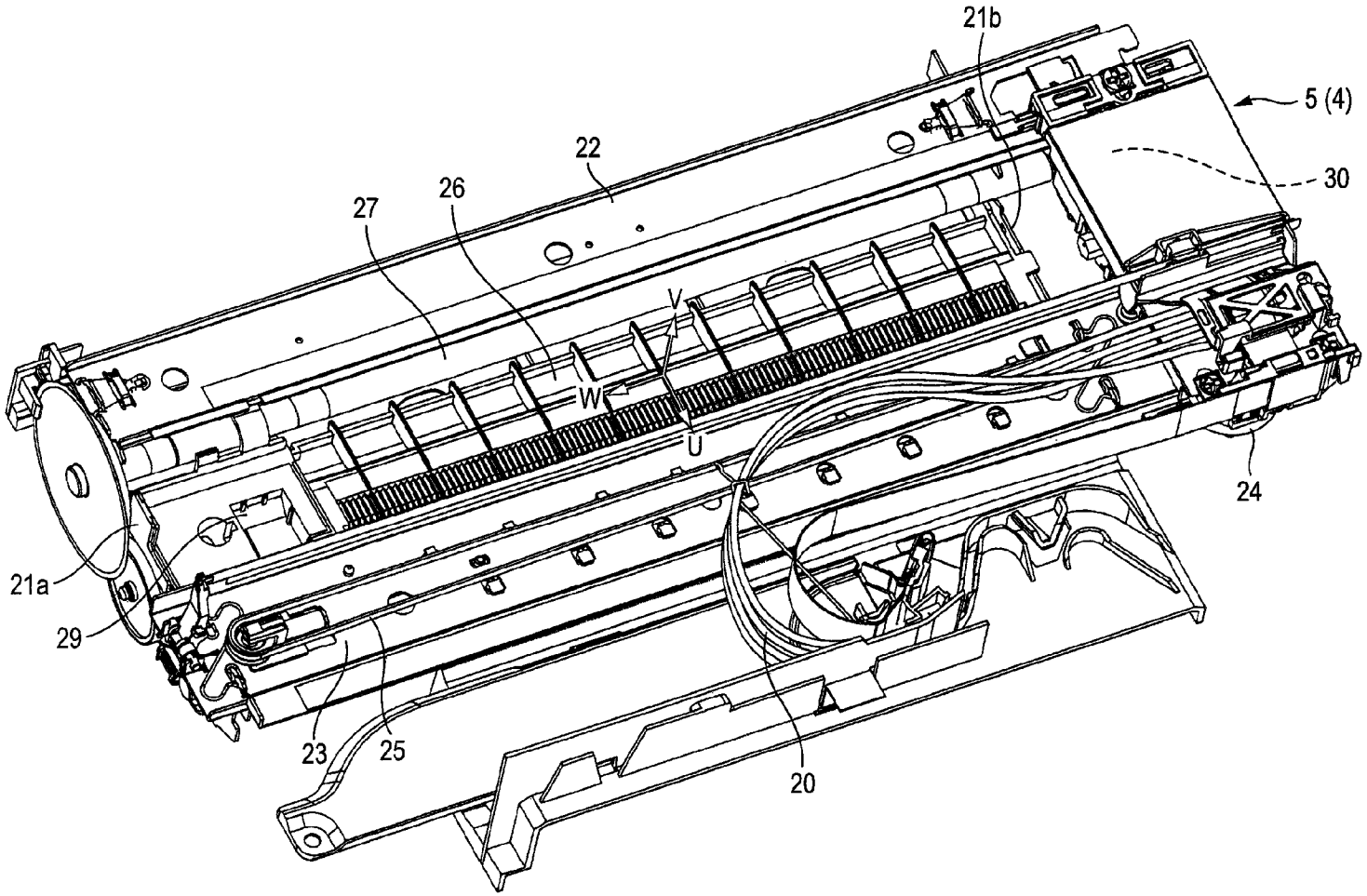
FIG. 4 is a perspective view of the recording section.

As shown in FIGS. 2 and 4, the recording section 7 is supported by a pair of left and right lateral plates 21*a* and 21*b* of a main frame 21 having a frame-like shape opened at its upper face. The recording section 7 includes: a first guide member 22 and a second guide member 23, each having a horizontally elongated plate shape (plate-like shape) extending in the X-axis direction (the main scanning direction); a carriage 5 formed to stride over both of these guide members 22 and 23 so as to be slidably supported (mounted) and reciprocatingly movable; a timing belt 25 serving as an endless belt that is wound around a pulley and located at an upper face of the second guide member 23 so as to be parallel therewith in order to enable the reciprocation of the carriage 5 equipped with the recording head 4; a carriage (CR) motor 24 for driving this timing belt 25 (although this motor is a DC motor in an aspect, other motors such as a stepping motor may be alternatively used); a plate-like platen 26 that supports the sheet P to be conveyed at a lower face side of the recording head 4; and a tape scale (not shown) serving as a constituent element of an optical linear encoder for detecting the position and movement speed of the carriage 5 in the X-axis direction (the main scanning direction), which is located to extend in the main scanning directions. The first guide member 22 and the second guide member 23 are located respectively at an upstream side and a downstream side of the sheet conveying direction as the direction indicated by the arrow A of FIG. 3 in a direction in which the sheet P passes through and over the platen 26.

A pair of resist rollers 27 is located at the conveyance downstream side with the platen 26 sandwiched therebetween to send the sheet P to a gap between a nozzle face at the lower face of the recording head 4 and the platen 26. At a downstream side of the platen 26, a spur 28*b* which comes into contact with an upper face of the sheet P, and a sheet discharge roller 28*a*, driven at a lower face side, are located so that the sheet P, on which recording has been performed, is conveyed to the sheet discharge section 10.

Furthermore, an ink receiver 29 and a maintenance unit 30 are provided at positions outward of the width of the sheet P (the short side of the sheet P) to be conveyed. The ink receiver 29 is located at one end side at a region close to the left lateral plate 21*a* in FIGS. 2 and 4. The maintenance unit 30 is located at the other end side at a region close to the right lateral plate 21*b* in FIGS. 2 and 4. Thus, at a flushing position provided at the ink receiver 29, the recording head 4 regularly discharges ink in order to prevent nozzle clogging during recording operation, and the ink receiver receives the ink. At the maintenance unit 30 portion, the carriage 5 is put in a standby position, and recovery processes for selectively sucking ink for each color, and for removing bubbles within a buffer tank (not shown) located over the recording head 4 are performed, for example. Moreover, although not shown in the maintenance unit 30, a wiper is provided to perform the cleaning of the nozzle face of the recording head 4 when the carriage 5 is moved from the maintenance unit 30 portion toward an image recording region.

The structure of the cartridge container 15 will be described. The cartridge container 15, in which four colors of inks for full-color recording are accommodated, has a small area in plan view, and includes a containing case body 74 capable of containing ink cartridges 60. The ink cartridges 60 is related to black (BK) ink, cyan (C) ink, magenta (M) ink and yellow (Y) ink, each formed into an approximately rectangular box shape having a large height dimension, in a manner that the ink cartridges 60 are arranged in a row along the X-axis direction. The cartridge container 15 is formed so that a door body 76 for opening and closing an opening at a front face of the containing case body 74 is opened to allow the ink cartridge 60 to be insertable into and removable from the front.

As shown in FIG. 6B and FIGS. 7A to 7C, at the connecting body 62 serving as a connecting unit attached to a rear end of the containing case body 74, four needle-like (tubular) ink inlets 63, associated with the respective ink cartridges 60, are integrally and protrusively formed so as to penetrate through a vertical plate 62*a*. The device is formed so that ink is supplied from the respective ink cartridges 60 to the ink-jet recording head 4 via ink tubes 20 each having one end connected to a connecting portion at a back face of each of these ink inlets 63, as shown in FIGS. 2, 4, 6B, 12B and 13. When more than four ink colors (e.g., six through eight colors) are used, the cartridge container 15 may be formed to be capable of containing a corresponding number of the ink cartridges 60, and the number of the ink tubes 20 may also be increased in accordance with the number of the ink cartridges.

Figure 5:
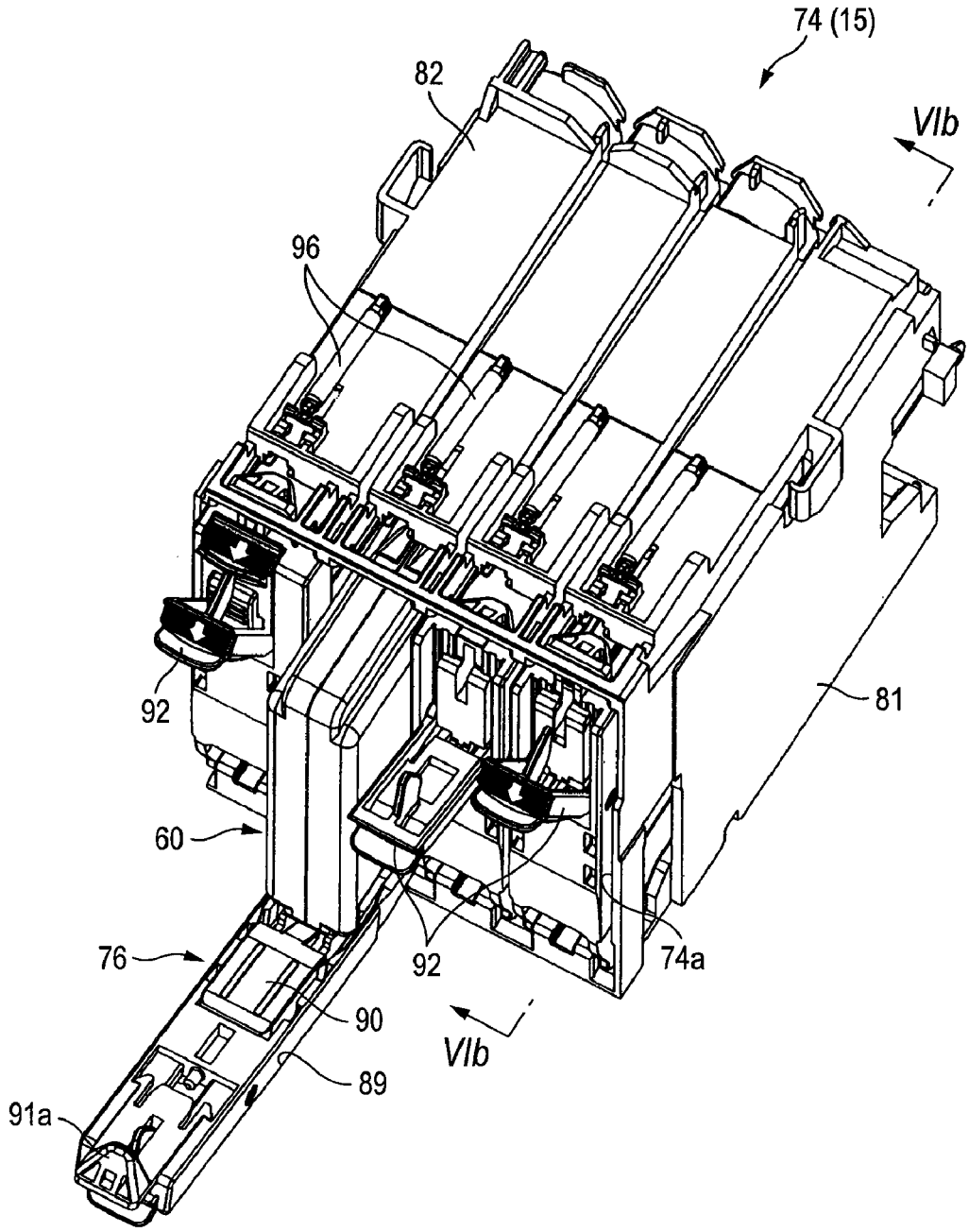
FIG. 5 is a perspective view of a cartridge container.

The ink cartridges 60 each include a cartridge body 64 made of synthetic resin, and ink contained therein. In an aspect, since the cartridge container 15 is formed to accommodate the four ink cartridges 60, inks of cyan, magenta, yellow and black colors are stored in the respective ink cartridges 60. As shown in FIGS. 1 and 5, the structures of the respective ink cartridges 60 are formed so that only the ink cartridge for storing black ink is slightly larger in the thickness direction than the ink cartridges for storing the other colors of inks. This is because black ink is in greatest demand and is heavily consumed in general. The ink cartridges 60 for storing color inks other than black color ink all have similar structures.

In an aspect, the cartridge body 64 is formed into a thin rectangular parallelepiped shape as a whole, and an ink accommodating space for accommodating ink is defined therein. This cartridge body 64 is made up of halved right and left tray-like members, and is provided by bonding these two members together by welding or another fixing method.

Figure 6A:
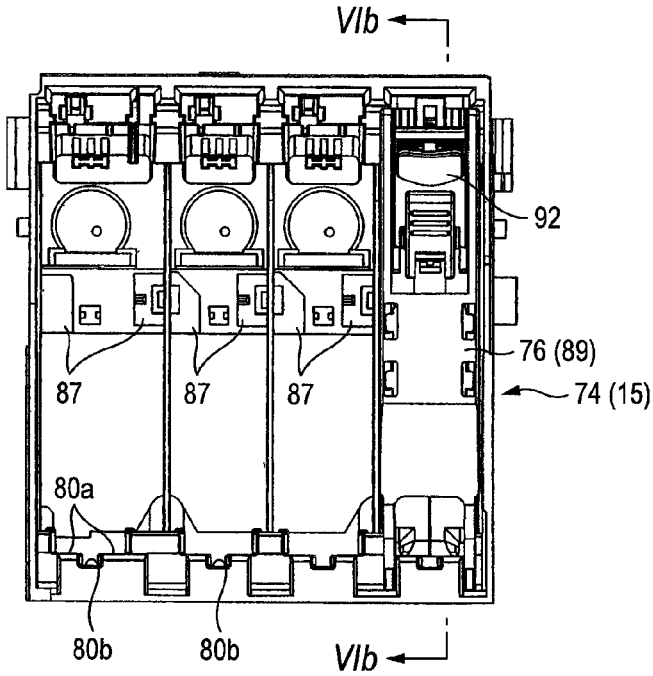
FIG. 6A is a front view of the cartridge container.
Figure 6B:
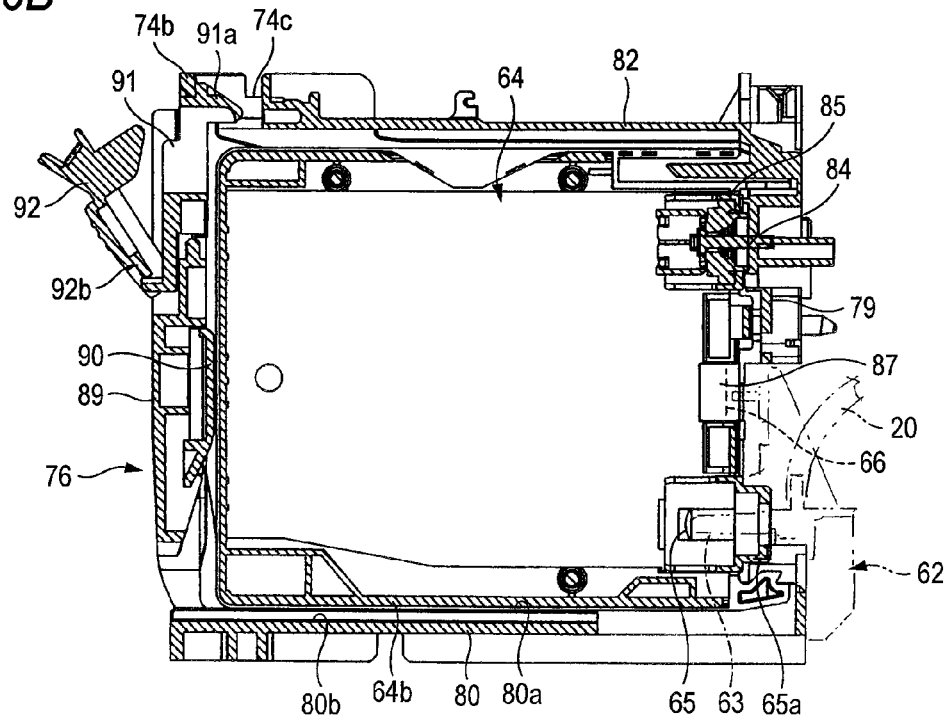
FIG. 6B is a cross-sectional view taken along the arrows VIb-VIb in FIG. 5.
Figure 7A:
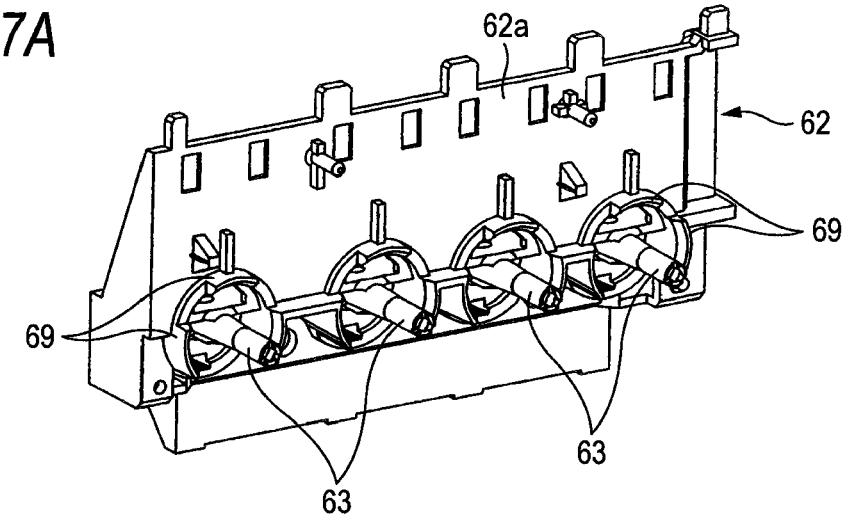
FIGS. 7A to 7C are perspective views each showing a connecting body.
Figure 7B:
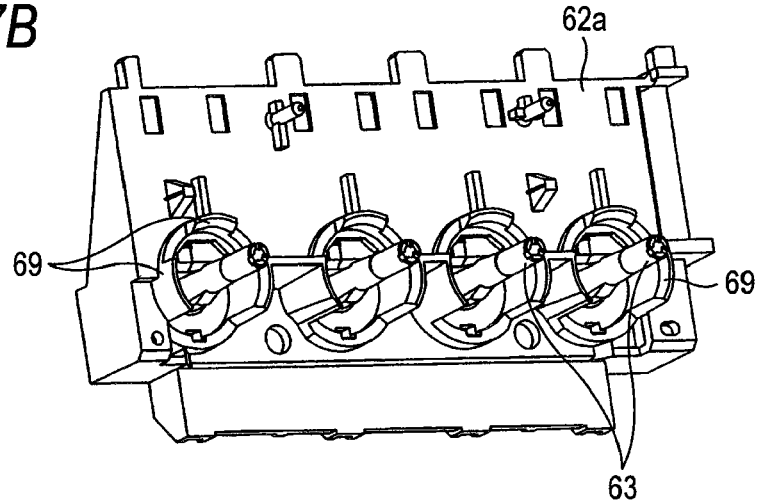
Figure 7C:
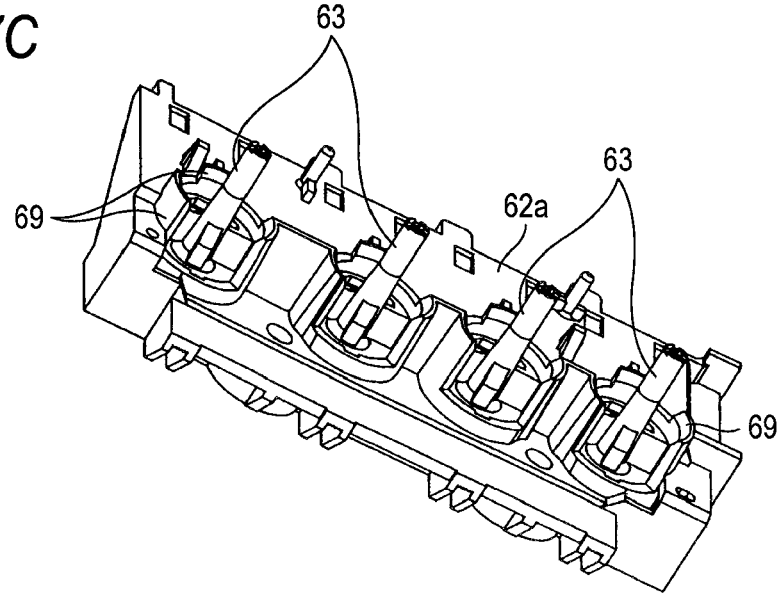

An air induction valve 85 is provided at an upper region and a rear face of the cartridge body 64. A check valve (not shown) is located at a back portion of this air induction valve 85. When the ink cartridge 60 is accommodated in the containing case body 74, a push rod 84, which is provided at the air induction valve 85 and protruded from the ink cartridge 60, abuts against a back wall of the containing case body 74. Thus, the push rod 84 is pushed back to an inner portion of the ink cartridge 60. As a result, the check valve is opened. Further, an ink supply valve 65 is provided at a lower region and rear face of the cartridge body 64. The ink supply valve 65 is located at an inner diametrical portion of a guide tube 65*a* protrusively formed at the rear face of the cartridge body 64, as shown in FIG. 6B. A plurality of circular arc guide ribs 69 shown in FIGS. 7A to 7C, protrusively formed at a surface of the vertical plate 62*a* of the connecting body 62, are each fitted to an outer diametrical portion of the guide tube 65*a* to serve as a guide at the time of insertion. When the ink cartridge 60 is accommodated (set) in the containing case body 74, the ink supply valve 65 is connected with the tubular ink inlet 63 provided at a rear face of the containing case body 74.

The ink within the ink cartridge 60 is supplied to the recording head 4 via the ink inlets 63 and the ink tubes 20. The cartridge body 64 is provided at its rear face with a detected part 66 for the detection of the liquid level of the ink within the ink cartridge 60. A detected body (actuator), (not shown) is moved in accordance with a remaining amount of ink, and is provided inside the ink cartridge 60. When the ink cartridge 60 is accommodated (set) in the containing case body 74, a liquid level sensor 87 such as a photo interrupter provided at the rear face (back face) of the containing case body 74 via this detected part 66 adjoins the ink cartridge 60 to detect presence or absence of the detected body, thus enabling the constant monitoring of the ink liquid level.

Figure 8:
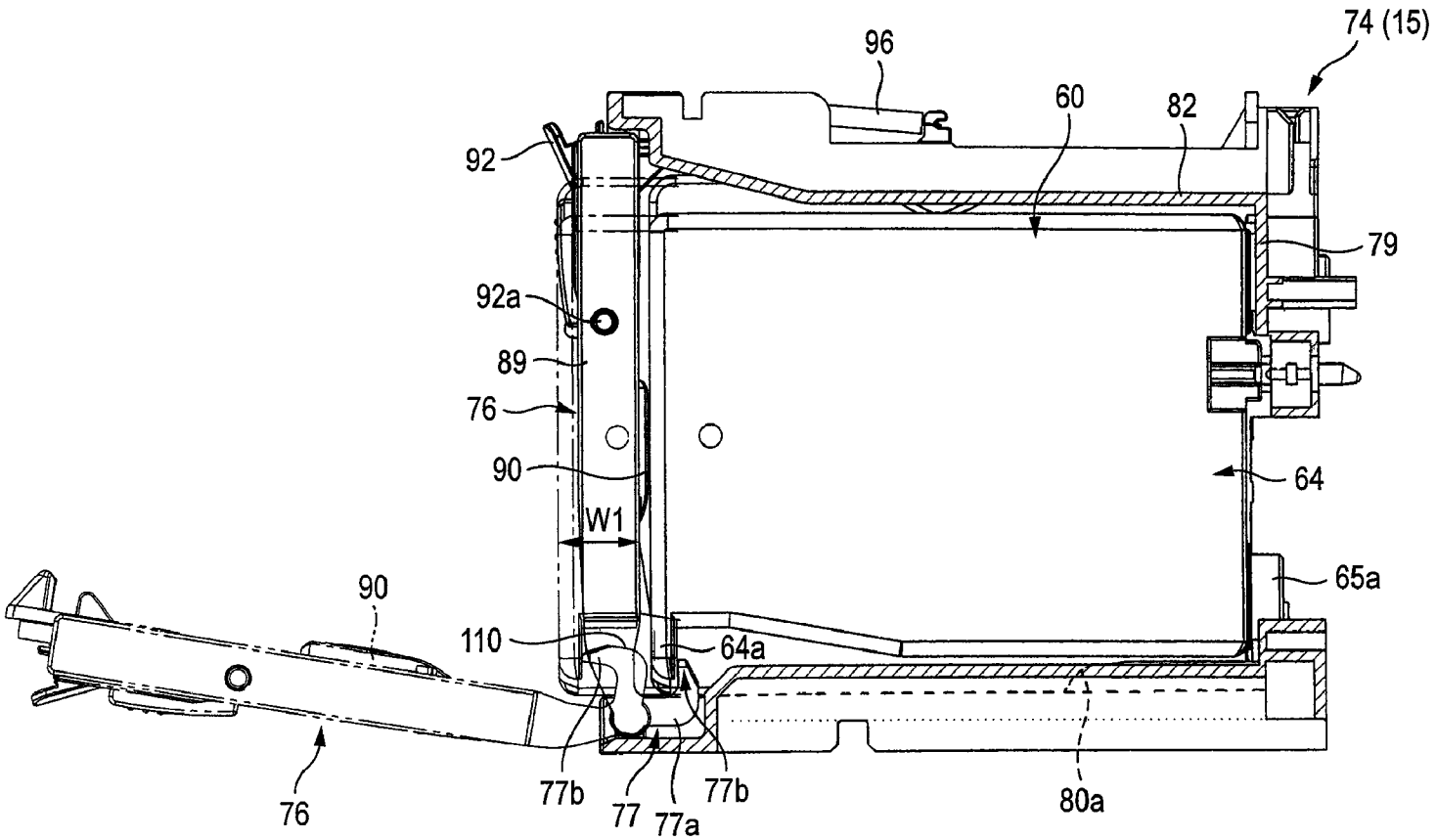
FIG. 8 is a sectional side view showing a state where an ink cartridge is contained.
Figure 9:
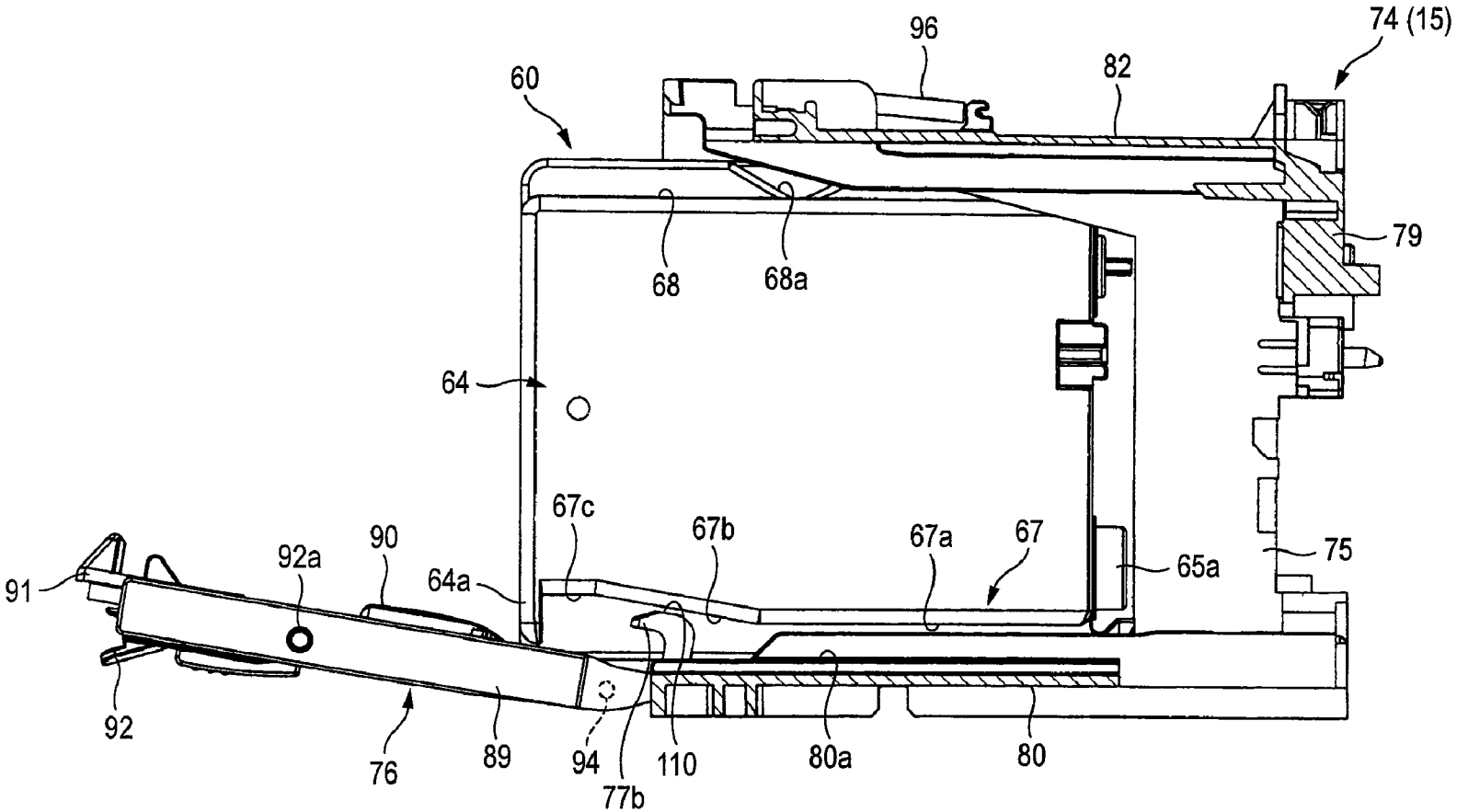
FIG. 9 is a sectional side view showing a state where the ink cartridge is being removed.

The cartridge body 64 is provided at its lower face with a guide groove 67 elongated along a direction in which the cartridge body 64 is inserted into the containing case body 74. As shown in FIGS. 8 and 9, the guide groove 67 is concavely provided at a corner of the boundary between a lateral face and a bottom face of the cartridge body 64. As shown in FIG. 8, this guide groove 67 is extending in the longitudinal direction of the cartridge body 64.

In an aspect, the guide groove 67 is symmetrically provided at both right and left sides of the cartridge body 64. This guide groove 67 includes a shallow groove portion 67*a*, a boundary groove portion 67*b* and a deep groove portion 67*c*. The shallow groove portion 67*a* is opened at the rear face of the cartridge body 64 and is extended toward the front face of the cartridge body 64 continuously from the rear face. The boundary groove portion 67*b* is continuous with the shallow groove portion 67*a* and is gradually increased in groove depth, as shown by the vertical dimension of FIGS. 8 and 9. The deep groove portion 67*c* is continuous with the boundary groove portion 67*b*. The deep groove portion 67*c* is shielded by an engaging piece 64*a* formed integrally with the front face of the cartridge body 64, so as not to be opened toward the front face.

In an aspect, a flat bottom plate 64*b* of the cartridge body 64 is placed onto upper faces of a pair of flat guide rails 80*a* formed at a bottom plate portion 80 of the containing case body 74. Thus, the cartridge body 64 is linearly guided at the time of insertion and removal of the ink cartridge 60, as disclosed in FIGS. 5, 6A, 6B, 8 and 9. A groove 80*b*, which has a concave cross section and is located between a pair of the flat guide rails 80*a*, serves as a groove through which leaked ink escapes.

The cartridge body 64 is also provided at its upper face with a groove 68. This groove 68 is concavely provided at a corner of the boundary between a lateral face and an upper face of the cartridge body 64. This groove 68 extends in the longitudinal direction of the cartridge body 64, and is continuous with the front and rear fates of the cartridge body 64. A concave portion 68*a* is provided at a midway point along the longitudinal direction of the upper face of the cartridge body 64. This concave portion 68*a* is approximately V-shaped, and includes a front-side inclined surface and a rear-side inclined surface.

The containing case body 74 is made of resin, for example, and is formed into an approximately rectangular parallelepiped shape as a whole. The containing case body 74 includes: the bottom plate portion 80; a pair of lateral plate portions 81 vertically provided at both right and left sides of this bottom plate portion 80; a top plate portion 82 located so as to serve as a bridge between the lateral plate portions 81; and a rear plate portion 79 provided adjacent to the top plate portion 82 to connect the right and left lateral plate portions 81. Furthermore, the containing case body 74 has a front face opening 74*a*, and the containing case body 74 is provided with dividing walls 75 within for defining accommodating chambers 78 each serving as a cartridge containing part in which each ink cartridge 60 is accommodated and held. The dividing walls 75 are located in accordance with the number of the ink cartridges 60 accommodated in the containing case body 74, as disclosed in FIGS. 9, 11 and 12B.

In an aspect, the containing case body 74 includes the four accommodating chambers 78, and is formed so that the four ink cartridges 60 are insertable into and removable from the respective accommodating chambers 78 through the front face opening 74*a*. An inner wall face of each accommodating chamber 78 is formed into a shape corresponding to that of an outer circumferential face of each ink cartridge 60. Therefore, each ink cartridge 60 is securely and reliably held in the containing case body 74. Naturally, these dividing walls 75 do not have to be provided to perfectly define the respective accommodating chambers 78, but may each be formed into a rib-like shape, by which the adjacent accommodating chambers 78 are partitioned, at least at the back of the containing case body 74, in other words, at its portion close to the rear plate portion 79. The bottom plate portion 80, the lateral plate portions 81, the top plate portion 82, the rear plate portion 79 and the dividing walls 75 may be integrally formed.

The guide rail 80*a* serving as a placement surface, on which the ink cartridge 60 is placed so as to be slidable along the longitudinal direction thereof, is formed at an upper face of the bottom plate portion 80, as shown in FIG. 6B. When the ink cartridge 60 is inserted into the accommodating chamber 78, the height of each guide rail 80*a* is set so that the needle-like (tubular) ink inlet 63 is inserted into the ink supply valve 65 of the ink cartridge 60, the air induction valve 85 of the ink cartridge 60 is opened by the push rod 84, and the liquid level sensor 87 can be fitted to the detected part 66 of the ink cartridge 60. According to the above structure, air can flow into the inside of the ink cartridge 60 through the air induction valve 85, and the ink within the ink cartridge 60 is smoothly sent toward the recording head 4.

Figure 11:
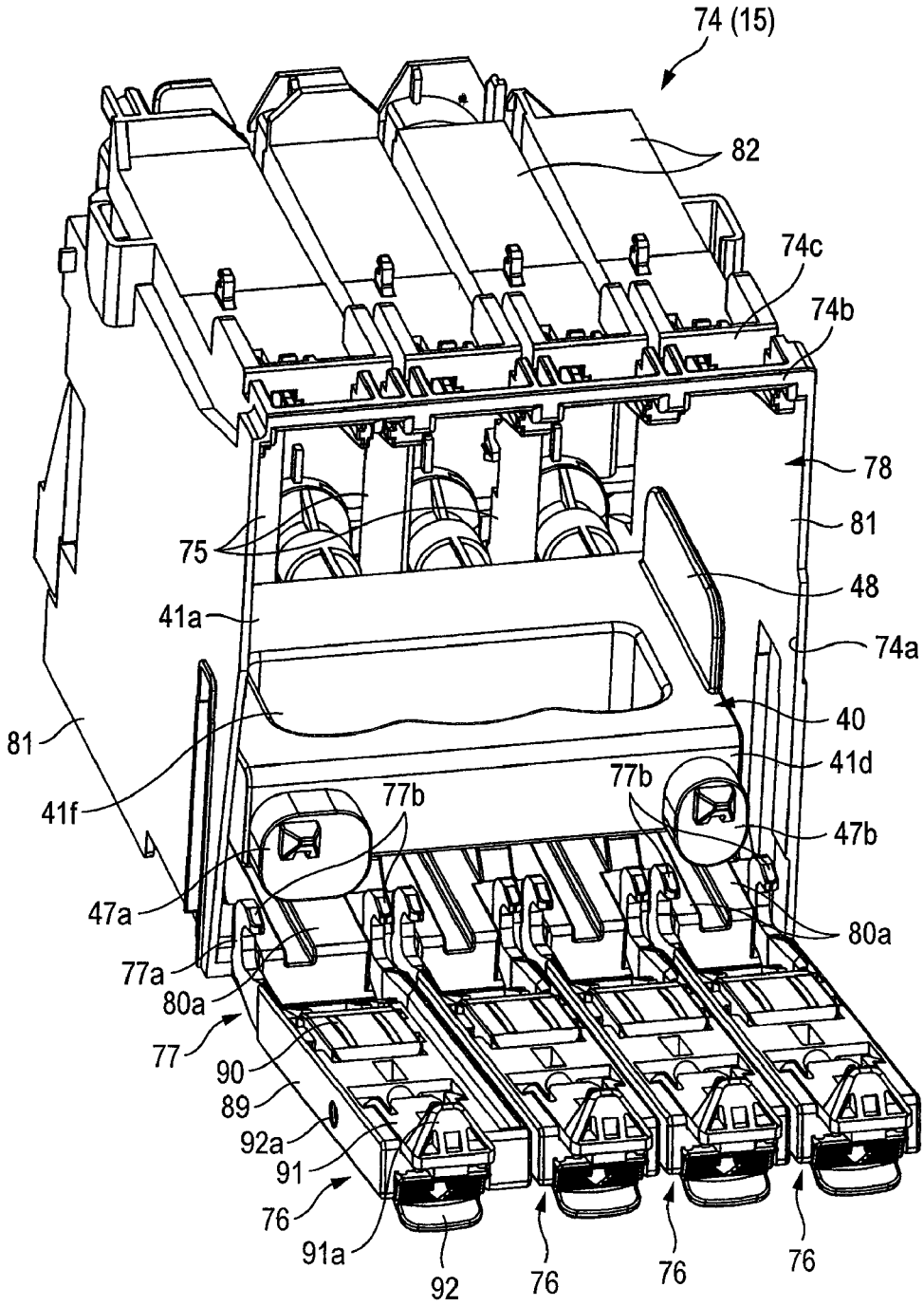
FIG. 11 is a perspective view showing a state where the protective cap unit is attached to the cartridge container.

As shown in FIGS. 5 and 11, at the front face opening 74*a* of the containing case body 74, the door bodies 76 are provided so as to be associated with the respective accommodating chambers 78. In other words, the accommodating chambers 78 are each defined inside the containing case body 74 so as to be continuous with the front face opening 74*a*. The four ink cartridges 60 are each insertable into and removable from the respective accommodating chambers 78 from the front faces thereof through the front face opening 74*a*.

The door body 76 made of synthetic resin or the like is pivoted, via a horizontal shaft 94 formed at its lower end, on a front lower end of the containing case body 74 so as to be rotatable upward and downward. The door body 76 is changed in position between a position (closing position) for closing the front face opening 74*a* and a position (opening position) for opening the front face opening 74*a*, as shown in FIG. 5. When the door body 76 assumes the closing position, the ink cartridge 60 is reliably held in the accommodating chamber 78. When the door body 76 assumes the opening position, the ink cartridge 60 is easily insertable into and removable from the accommodating chamber 78.

As shown in FIGS. 5, 6B, 8, 9, 11, 12A and 12B, the door body 76 includes a door main body 89, a pressing and holding member 90 provided thereto, a lock member 91 and an unlock lever 92, which are each made of resin.

At a lower end of the door main body 89, a pair of right and left pullout members 77 is integrally molded. The pullout members 77 are each formed into an approximate L-shape (hook-like shape) and have an extended portion 77*a* and a curved portion 77*b*. As shown in FIG. 8, the extended portion 77*a* is extended backward from the lower end of the door main body 89 in a state where the door body 76 assumes the closing position. On the other hand, the curved portion 77*b* is continuous with a rear end of the extended portion 77*a* and is extended upward at an angle of about 90°. When the door body 76 assumes the closing position, a front edge of the curved portion 77*b* is protruded upwardly from the placement surface (guide rail) 80*a*. By causing the pullout members 77 to be rotated together with the door main body 89, the front edge of the curved portion 77*b* pushes the engaging piece 64*a* of a front lower end of the ink cartridge 60 in the pullout direction, thereby pulling out the ink cartridge 60 from the accommodating chamber 78 by only a slight distance W1, as the alternating long and short dashed lines shown in FIG. 8.

As shown in FIG. 8, when the position of the door body 76 is changed to the opening position, the curved portion 77*b* of each pullout member 77 is rotated around the horizontal shaft (rotating shaft) 94 in a counterclockwise direction. At this time, due to the rotation of the curved portion 77*b*, an outer wall face (outer end face) 110 thereof is changed from an approximately vertically erected state to an approximately horizontal state (see FIG. 8). The length of the extended portion 77*a* of each pullout member 77 is set at a predetermined length. Thus, when the curved portion 77*b* is rotated, the outer wall face 110 thereof is located slightly higher than the placement surface (guide rail) 80*a* of the containing is case body 74, and is extended forward and backward. Further, when the door body 76 assumes the opening position, this outer wall face 110 functions as a guide face for guiding the ink cartridge 60 onto the placement surface 80*a* within the accommodating chamber 78. The pullout members 77 each function as a member for pulling out the ink cartridge 60 from the accommodating chamber 78, and also function as a guiding member during the insertion of the ink cartridge 60 into the accommodating chamber 78.

As shown in FIGS. 5, 6B, 8, 9, 11 and 12B, the pressing and holding member 90 is attached to an inner lateral face of the door main body 89 so as to be movable forward and backward. Furthermore, due to a compression coil spring (not shown) interposed between the pressing and holding member 90 and the door main body 89, the pressing and holding member 90, formed into a plate-like shape for example, is elastically biased so as to constantly assume the above-described protruding position. Accordingly, when the door body 76 assumes the closing position, the pressing and holding member 90 abuts against the front face of the ink cartridge 60, and is held in a state where the position of the ink cartridge 60 is determined with respect to the containing case body 74.

The lock member 91 is attached to an upper end of the door main body 89 so as to be vertically movable by a predetermined distance. The lock member 91 includes a collar portion 91*a* protruded upward at an inner side of the containing case body 74. Further, due to a bias spring that is not shown, the lock member 91 is elastically biased so that the collar portion 91*a* constantly protrudes upward from the door main body 89. Furthermore, an upper face of the collar portion 91*a* of the lock member 91 provides an inclined surface that is inclined downward. As shown in FIG. 5 and FIG. 65, when the position of the door body 76 is changed from the opening position to the closing position, the upper face of the collar portion 91*a* of the lock member 91 abuts against an upper edge 74*b* at the front face opening 74*a* of the containing case body 74. When the door body 76 is rotated further toward the closing position, the lock member 91 recedes toward the inside of the door main body 89 while being relatively pressed by the upper edge 74*b*. If the collar portion 91*a* is fitted into an engaging hole 74*c* at the back of the upper edge 74*b*, the closing position of the door body 76 is maintained. As shown in FIG. 6A, only the rightmost door body 76 is shown, and the door bodies 76 in front of the three left accommodating chambers 78 are omitted.

Figure 12A:
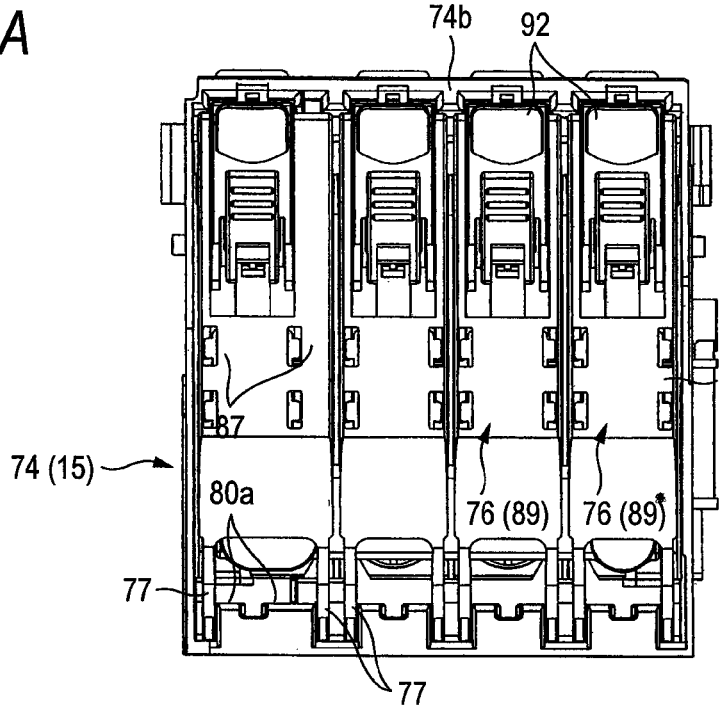
FIG. 12A is a front view showing a state where the protective cap unit is attached to the cartridge container.
Figure 12B:
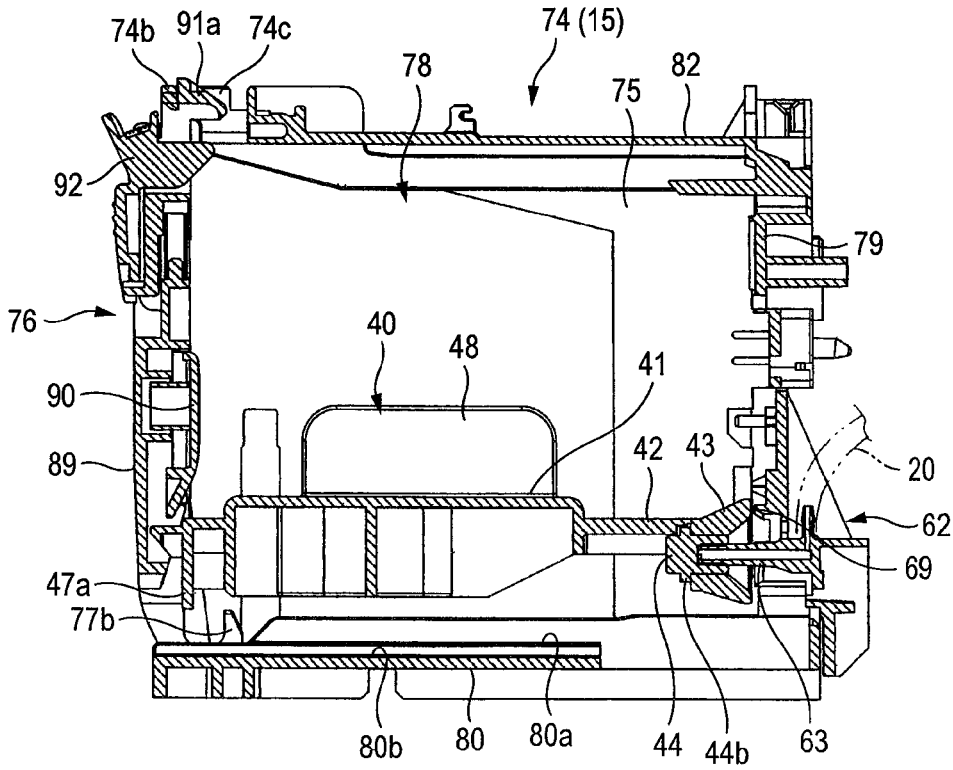
FIG. 12B is a sectional side view thereof.

As shown in FIGS. 5 and 6B, the unlock lever 92 is formed into a rectangular plate-like shape and is attached to an upper outer lateral face of the door main body 89. The unlock lever 92 is formed so as to be rotatable, via a support pin 92*a* provided at a lower end thereof, with respect to the door main body 89. In an aspect, the unlock lever 92 is formed so as to be freely rotatable to assume the following positions: an erected position in which the unlock lever 92 is erected as shown in FIGS. 8 and 12B and is thus approximately parallel with the outer lateral face of the door main body 89; a neutral position in which the unlock lever 92 is inclined forward at an angle of about 40° with respect to the vertical plane, as shown in FIG. 6B; and a lying position in which the unlock lever 92 is lying approximately horizontally, as shown in FIG. 5.

As shown FIG. 6B, when the position of the unlock lever 92 is changed from the neutral position to the lying position, the lock member 91 is pushed downward to carry out unlocking by a cam portion 92*b* formed at the lower end of the unlock lever 92. The unlocking means disengages the collar portion 91*a* from the engaging hole 74*c*.

It should be noted that a swing arm (not shown), which is provided at the top plate portion 82 of the containing case body 74 and is approximately L-shaped in side view to face an upper portion of the accommodating chamber 78 via a through hole, is biased by a tension bias spring 96 so as to be rotated in a direction in which the ink cartridge 60 is constantly pressed. When a lower end of the swing arm is abutted against an upper face of the ink cartridge 60 inserted into the accommodating chamber 78, the swing arm resists an elastic force of the tension bias spring 96 and receives a reactive force from the ink cartridge 60. Accordingly, if the door body 76 is opened widely as described above to pull out the ink cartridge 60 to the position indicated by the alternating long and short dashed lines in FIG. 8, upon fitting of the lower end of the swing arm into the approximately V-shaped concave portion 68*a* provided at the upper face of the ink cartridge 60, the ink cartridge 60 can be forcedly pushed out to a state shown in FIG. 9 due to the rotation of the swing arm that has received the reactive force.

The used ink cartridge 60 is replaced as follows. When the used ink cartridge 60 is taken out of the containing case body 74, the door body 76 is first opened. When the position of this door body 76 is changed from the closing position to the opening position, a pair of the pullout members 77 catch the engaging piece 64*a* of the lower end of the ink cartridge 60 to pull out the ink cartridge 60 toward the opening. Thus, it becomes easy for an operator to pull out the ink cartridge 60 through the front face opening 74*a*. Further, when the ink cartridge 60 is accommodated in the accommodating chamber 78, the ink cartridge 60 is inserted into the accommodating chamber 78 through the front face opening 74*a* in a state where the door body 76 is opened. At this time, a front lower face of the ink cartridge 60, which is to be inserted into the accommodating chamber 78, is supported in advance by a pair of the pullout members 77, and the ink cartridge 60 is inserted into the accommodating chamber 78 while being guided by the pullout members 77. Furthermore, a rear (back) lower face of the ink cartridge 60 is placed on the flat placement surface 80*a* and is slid thereon. Accordingly, the ink cartridge 60 is simply, reliably and smoothly insertable into and removable from the accommodating chamber 78.

In a state where the new ink cartridge 60 is accommodated in the containing case body 74, an operator may change the position of the door body 76 to the closing position again. When the position of the door body 76 is changed to the closing position, the pressing and holding member 90 abuts against the front face of the ink cartridge 60, and when the door body 76 perfectly assumes the closing position, the pressing and holding member 90 elastically biases the ink cartridge 60 toward the back of the accommodating chamber 78 of the containing case body 74. At the same time, the collar portion 91*a* of the lock member 91 is fitted into the lock member fitting hole 74*c* provided at the containing case body 74, and the closing position of the door body 76 is maintained.

In this state, if the ink cartridge 60 is accommodated (set) in the containing case body 74, the ink supply valve 65, provided at the lower region of the rear face of the cartridge body 64, is connected with the tubular ink inlet 63 provided at the rear face (back face) of the containing case body 74. Thus, ink is supplied to the recording head 4 via this ink inlet 63 and the ink tube 20. The air induction valve 85 provided at the upper region of the rear face of the cartridge body 64 is pressed by the containing case body 74. The check valve at the back of the air induction valve 85 is opened by the push rod 84, which has been pushed back inside the ink cartridge 60, to cause atmospheric pressure to act on the ink within the cartridge body 64, thus realizing smooth ink supply.

Description will be made of the structure of a protective cap unit 40 to be attached during shipment and transportation of the image recording device 1, instead of the ink cartridge 60 being connected to the ink inlet 63 of the cartridge container 15.

A first aspect of the protective cap unit 40 is shown in FIGS. 10A to 10D. The protective cap unit 40 is associated with a set of the four ink cartridges 60. In other words, a set of the four tubular ink inlets 63 is substantially horizontally protruded toward the front face opening 74*a* from the back of the containing case body 74.

This protective cap unit 40 includes a flat main body 41, four supporting rods 42 extending parallelly toward the front edges of the ink inlets 63 from a rear face of this main body 41, trumpet-shaped (flared) guiding funnels 43 formed at front edges of the respective supporting rods 42, and elastic caps 44 attached to inner diametrical sides of the guiding funnels 43. Further, the overall shape of the protective cap unit 40 is formed into a flat shape having a different form from that of a set of the four ink cartridges 60 or that of each ink cartridge. Furthermore, the main body 41 is also formed into a flat shape having a different form from that of a set of the four ink cartridges 60 or that of each ink cartridge.

The main body 41, the supporting rods 42 and the guiding funnels 43 are integrally formed by subjecting a flexible material, e.g., a synthetic resin material, to injection molding. The elastic cap 44, having an approximately tubular shape consisting of a soft elastic body such as synthetic rubber, is provided at its front edge with an attachment concave portion 44*a* that is to be closely fitted to the front edge of the ink inlet 63. The base end of the elastic cap 44 is integrally molded with a large-diameter collar portion 44*b*.

As described above, the overall shape of the protective cap unit 40 has a different form from that of a set of the four ink cartridges 60 or that of each ink cartridge 60. Therefore, unlike the case where each link cartridge 60 is guided along a lateral face of the dividing wall 75 serving as a partition rib during the insertion of each ink cartridge 60 into the containing case body 74, the front edges of the ink inlets 63 are fitted into the attachment concave portions 44*a* of the elastic caps 44 via the respective guiding funnels 43 by only pushing in the protective cap unit 40 so as to cover the target ink inlets 63 with the guiding funnels 43. Since the front face side of the protective cap unit 40 is pressed by the door body 76 (door main body 89) that is rotated upward and closed, the main body 41 of the protective cap unit 40, which is reduced in weight, is maintained at a substantially horizontal position while being lifted from the placement surface 80*a*. The elastic caps 44 will not be disengaged from the ink inlets 63, thus making it possible to securely maintain the hermetically-closed state.

Further, in order to form the protective cap unit 40 that is reduced in weight and has flexibility, the main body 41 and the supporting rods 42 are each formed into a thin shape. Specifically, the main body 41 is formed into a downwardly opened casing-like shape by a top plate 41*a*, right and left lateral plates 41*b*, a front plate 41*d* and a back plate 41*e*, as shown in FIGS. 10A to 10D. Furthermore, the top plate 41*a* is provided at a midway point thereof with a concave portion 41*f* into which an operator's finger can be inserted, and an outer circumference of this concave portion 41*f* is connected to respective inner faces of the right and left lateral plates 41*b*, the front plate 41*d* and the back plate 41*e* by reinforcing ribs 41*g*. The supporting rods 42 are each formed into a semicylindrical shape.

Accordingly, when the main body 41 is pressed by the closed door body 76 and the elastic caps 44, each serving as a front end of the protective cap unit 40, are fitted to the ink inlets 63, the hermetic property (sealing property) of the elastic caps 44 for the ink inlets 63 is further improved due to the flexibility of the protective cap unit 40 itself.

Figure 13:
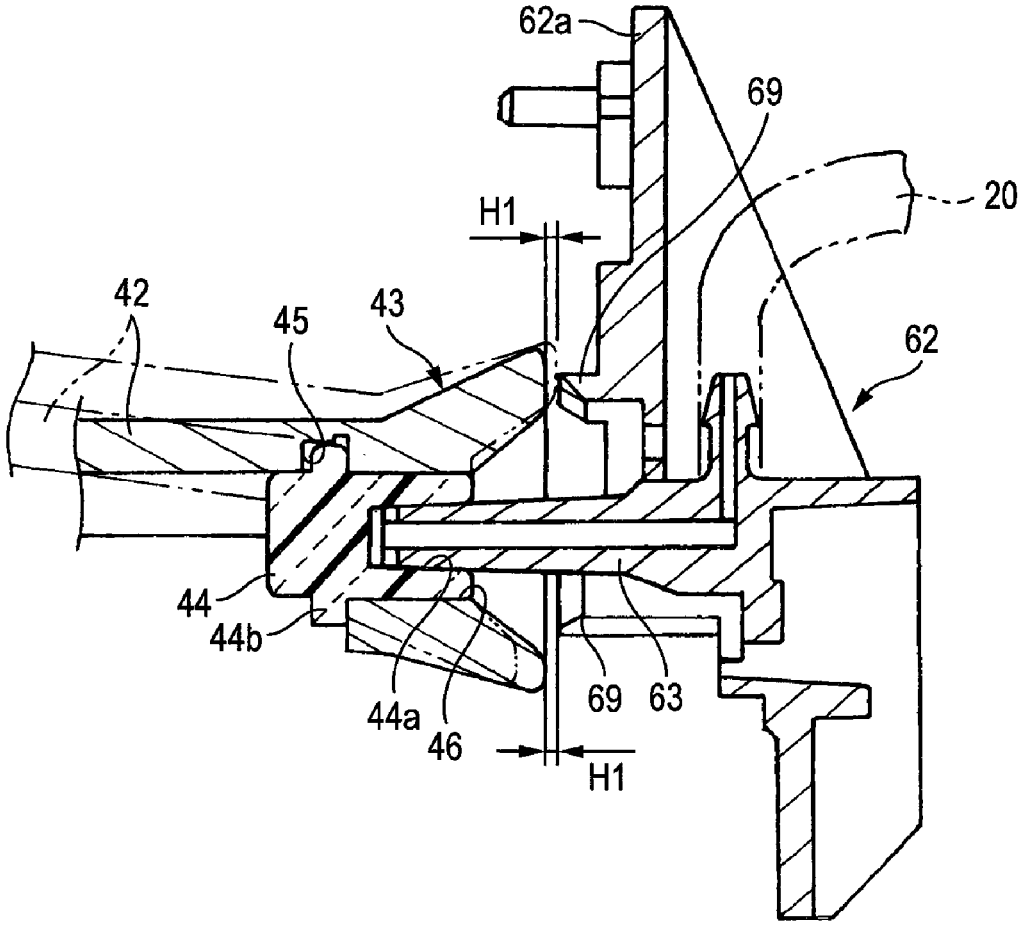
FIG. 13 is an enlarged sectional side view of a principal part, showing the positions of a protective cap and a guiding funnel with respect to an ink inlet.

As shown in FIG. 13, at a connected portion (connection) between the supporting rod 42 and the guiding funnel 43, a semi-annular groove 45, which is engaged with an approximately half circumferential part of the large-diameter collar portion 44*b* of the elastic cap 44, is formed, and a fitting hole 46, into which the elastic cap 44 is insertable from the supporting rod 42 side, is provided at an inner diametrical portion of the guiding funnel 43. Due to this structure, even if the elastic cap 44 is pressed by the ink inlet 63 in the axial direction thereof at the time of the above-described sealing, the large-diameter collar portion 44*b* is engaged with the semi-annular groove 45. Therefore, the elastic cap 44 will not bed is engaged from the connection between the supporting rod 42 and the guiding funnel 43. Further, in the case where the protective cap unit 40 is detached, even when an operator pulls out the protective cap unit 40 from the inside of the containing case body 74 by pinching only the main body 41 with fingers, the disadvantage that the elastic cap 44 is disengaged (comes off) from the inner diametrical portion of the guiding funnel 43 can be eliminated due to the large-diameter collar portion 44*b*.

Each supporting rod 42 has a semicylindrical shape, and the fitting hole 46 of the connected portion (connection) between the supporting rod 42 and the guiding funnel 43 is formed to penetrate therethrough. Thus, even if the large-diameter collar portion 44*b* exists at the base end side, the elastic cap 44 can be easily inserted into the guiding funnel 43.

Figure 10A:
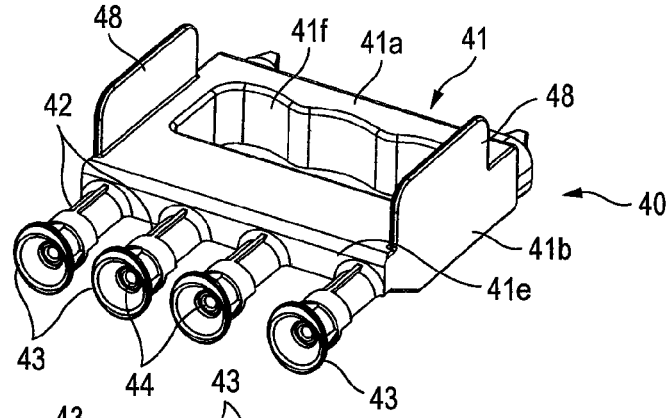
FIGS. 10A to 10D are perspective views each showing a protective cap unit of an aspect.
Figure 10B:
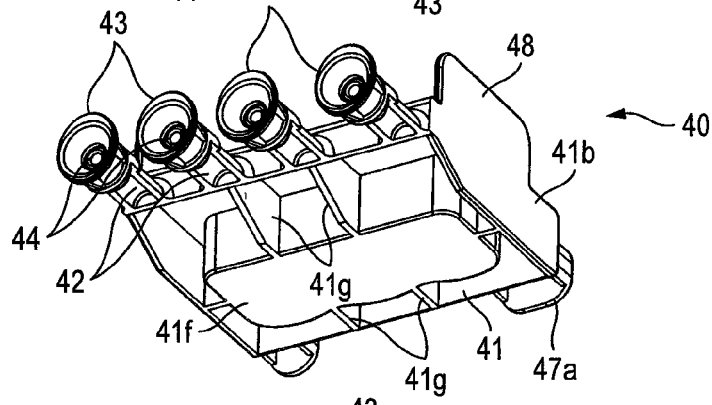
Figure 10C:
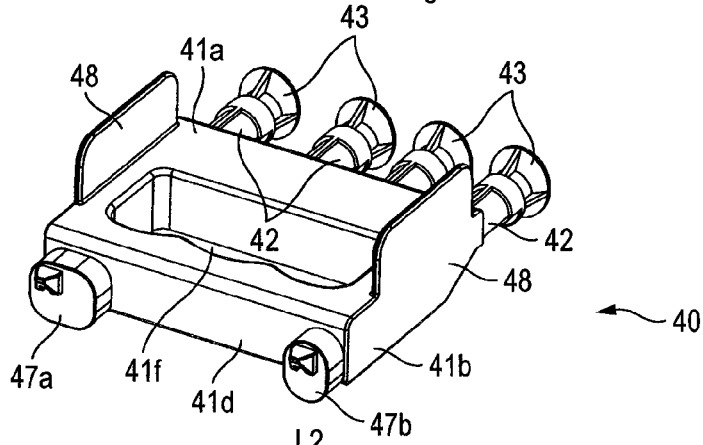
Figure 10D:
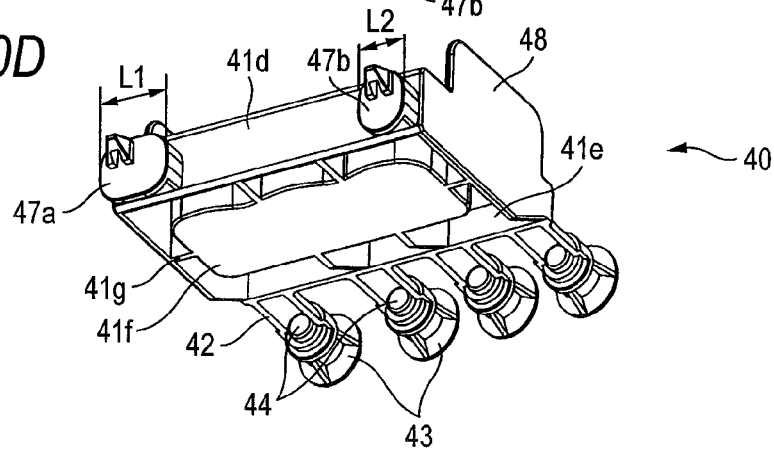

At the front plate 41*d* of the main body 41, guide protrusions 47*a* and 47*b*, having width dimensions (L1) and (L2) each equivalent to an inner width dimension of a pair of the associated pullout members 77 when the rightmost and the leftmost ink cartridges of the four ink cartridges 60 are inserted into the accommodating chambers 78, are integrally provided, as disclosed in FIGS. 10C, 10D and 11. Due to this structure, even if only one of the two door bodies 76 is first rotated in the closing direction, it is possible to push in the main body 41 approximately parallelly by guiding the guide protrusion 47*a* or 47*b* of the main body 41 with a pair of the associated pullout members 77. It should be noted that an operator may sequentially close the four door bodies 76 after having inserted the main body 41 into the containing case body 74 by pinching the main body 41 with fingers and fitting all the elastic caps 44 to all the ink inlets 63, as disclosed in FIG. 11. When the door bodies 76 are closed, the guide protrusions 47*a* and 47*b* are each preferably pressed by an inner face of the door main body 89.

As shown in FIGS. 10A to 10D and 11, fins 48, each having an appropriate height, are protrusively provided at both right and left ends of an upper face of the main body 41 so as to be protruded upward. Thus, when the protective cap unit 40 is inserted, assuming an improper position in which the fins 48 each serving as a restraining plate are downwardly protruded, the fins 48 get caught in the placement surfaces 80*a* within the accommodating chambers 78. Therefore, the axis of each supporting rod 42 is located higher than that of each ink inlet 63. Accordingly, it becomes impossible to fit each elastic cap 44 to each ink inlet 63 while the protective cap unit 40 is assuming the improper position in which the guiding funnel 43 side is positioned to face downward. Thus, an erroneous operation will be prevented. If regions of upper end faces of the fins 48, located close to the supporting rods 42, are reduced in height or rounded at the corners, the protective cap unit 40 is placed onto the placement surfaces 80*a* within the accommodating chambers 78 while the guiding funnel 43 side is positioned to face downward, thus allowing the in proper position condition to be easily visible.

When an operator inserts the main body 41 into the containing case body 74 by pinching the main body 41 with fingers, the operator can pinch the main body 41 by putting the index, middle and ring fingers into the concave portion 41*f* and abutting a thumb against the front plate 41*d* of the main body 41. The front plate 41*d* is located closer to a front edge of the concave portion 41*f* than the guide protrusions 47*a* and 47*b* protruded at both right and left ends of the front plate 41*d*, and a flat face portion of the front plate 41*d* can be increased, thus making it easy to pinch the main body 41 with fingers.

By protrusively providing only one fin 48, which serves as a restraining plate, at a position appropriately deviated toward one side from the horizontal center of the upper face of the main body 41, the center of gravity of the main body 41 is horizontally deviated when this fin 48 is abutted against the placement surface 80*a*. Therefore, the protective cap unit 40 is inclined so that one side thereof is located at a higher position and the other side thereof is located at a lower position. Also in this case, even if the protective cap unit 40 is inserted while the protective cap unit 40 is assuming an improper position, it is impossible to fit each elastic cap 44 to each ink inlet 63.

As shown in FIG. 12B and FIG. 13, in a hermetically closed position (sealed position) in which the ink inlet 63 is inserted into the attachment concave portion 44*a* of the elastic cap 44, an aspect is implemented so that a gap having an appropriate dimension H1 is formed between a front end of the guiding funnel 43 or a substantially cone-shaped inner diametrical face thereof and a front edge of the guide rib 69. To this end, the diameter of the flared enlarged-side inner diametrical portion of each guiding funnel 43 is made larger than the outer circumferential diameter of the cylindrical guide rib 69, or the flared enlarged-side inner diametrical portion of each guiding funnel 43 is formed into a vertically elongated elliptical shape or oval shape with respect to the cylindrical guide rib 69 and is formed to be deviated upward with respect to the diametrical center of the guide rib 69.

By forming the gap as described above, ink attached to the guide rib 69 can be prevented from moving to the guiding funnel 43.

FIGS. 14A to 16B show a protective cap unit 50 of second aspect. This protective cap unit 50 is a single type provided for each location of each of the ink cartridges 60 to be accommodated in the containing case body 74. The protective cap unit 50 includes a main body 51 elongated forward and backward, a supporting rod 52 provided continuously with a rear end of the main body 51 and elongated forward and backward similarly thereto, a guiding funnel 53 provided continuously with a front edge of the supporting rod 52, and an elastic cap 54 detachably attached to an inner diametrical portion of the guiding funnel 53. Accordingly, the overall shape of the protective cap unit 50 has a different form from that of each ink cartridge, and is formed into a slender shape elongated forward and backward.

The main body 51, the supporting rod 52 and the guiding funnel 53 are integrally formed by subjecting a flexible material, e.g., a synthetic resin material, to injection molding. The elastic cap 54 has the substantially same shape as in the first aspect, i.e., an approximately tubular shape consisting of a soft elastic body such as synthetic rubber, and the elastic cap 54 is provided at its front edge with an attachment concave portion 54*a* that is to be closely fitted to the front edge of the ink inlet 63, and is integrally molded at its base end with a large-diameter collar portion 54*b*.

Further, in order to form the protective cap unit 50 that is reduced in weight and has flexibility, the main body 51 and the supporting rod 52 are each formed into a thin shape as shown in FIG. 14A to 14D. Specifically, the main body 51 is formed into a solid shaft shape, and integrally includes small-diameter ribs 51*a* and a hook-like large-diameter rib 51*b* which prevent slipping when an operator pushes the protective cap unit 50 toward the front edge of the ink inlet 63 by pinching the protective cap unit 50 with fingers. Furthermore, at a front edge of the main body 51, an abutment portion 51*c*, whose front edge with a convexedly curved face abuts against the door main body 89, is integrally formed. The supporting rod 52 is approximately H-shaped in cross section at its front half portion, and is formed into a semicylindrical shape at its rear half portion.

As described above, the protective cap unit 50 of the second aspect is attached to each ink inlet 63. Therefore, the protective cap unit 50 of the second aspect can be further reduced in size as compared with the first aspect. Moreover, if an operator inserts the protective cap unit 50 so that the front edge of the ink inlet 63 is fitted into the attachment concave portion 54*a* of the elastic cap 54 via the rear-end guiding funnel 53 and then releases his or her hand, the large-diameter rib 51*b* abuts against the placement surface 80*a*, and the axis of the protective cap unit 50 can be maintained at a position substantially parallel with the plane of the placement surface 80*a*. Thereafter, if the door body 76 is rotated in the closing direction, the front face side of the protective cap unit 50 is pressed by the door body 76 (door main body 89) that is rotated upward and closed. Therefore, the main body 51 of the protective cap unit 50, which is reduced in weight, is maintained at a substantially horizontal position while being lifted from the placement surface 80*a*. The elastic cap 54 will not be disengaged from the ink inlet 63. Thus, the hermetically-closed state is securely maintained, as shown in FIG. 16B.

In addition, the protective cap unit 50 of the second aspect is formed into a slender shape corresponding to each ink inlet 63. The protective cap unit 50 is substantially thinner than the width dimension of each ink cartridge 60. Therefore, the protective cap unit 50 can be inserted into and attached to the ink inlet 63 at any position around the axis of the protective cap unit 50, thus making it possible to execute this attachment operation remarkably simply without error.

Thus, also in the second aspect, the protective cap unit 50 has an original function of covering and reliably protecting the ink inlet 63 during shipment, transportation and storage, and reduces trouble in an operation of sealing a single or a plurality of ink inlets although the protective cap unit is reduced in size and weight.

Figure 14A:
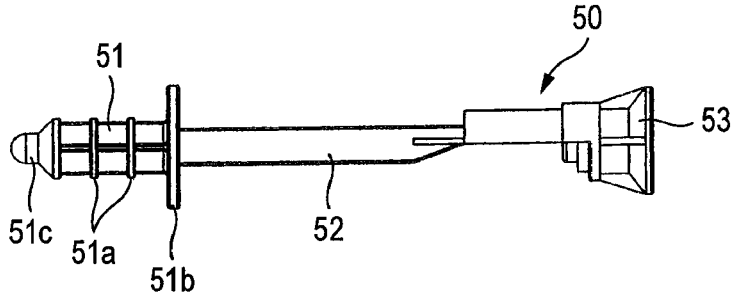
FIGS. 14A to 14D are diagrams each showing a protective cap unit of another aspect.
Figure 14B:
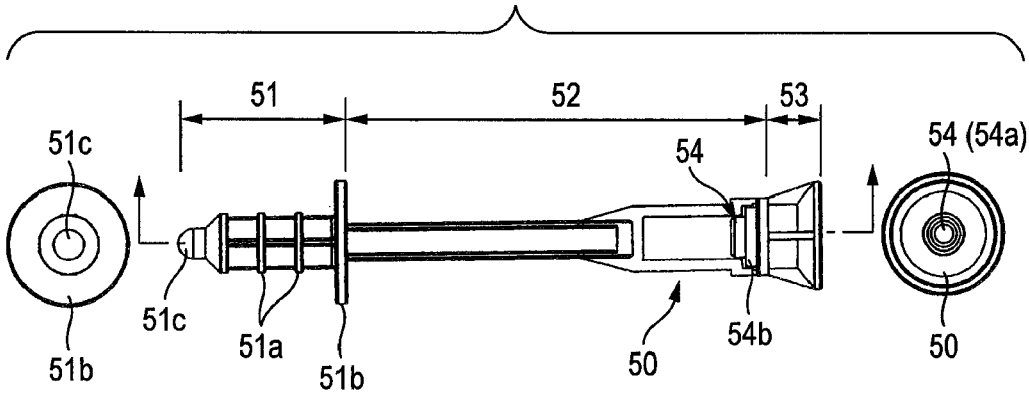
Figure 14C:
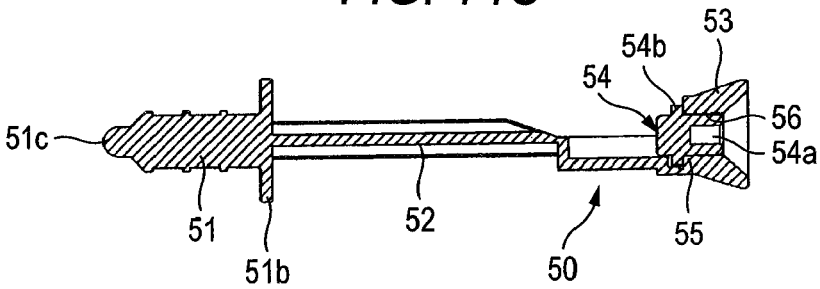
Figure 14D:
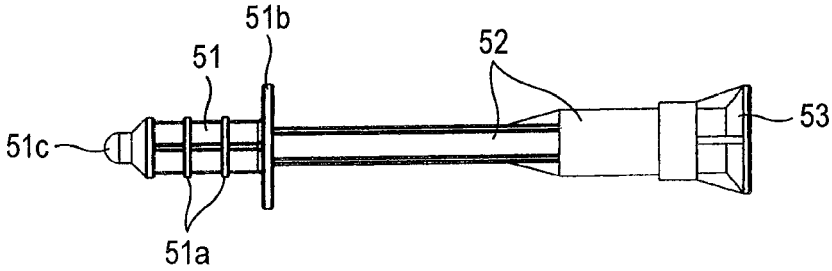
Figure 15:
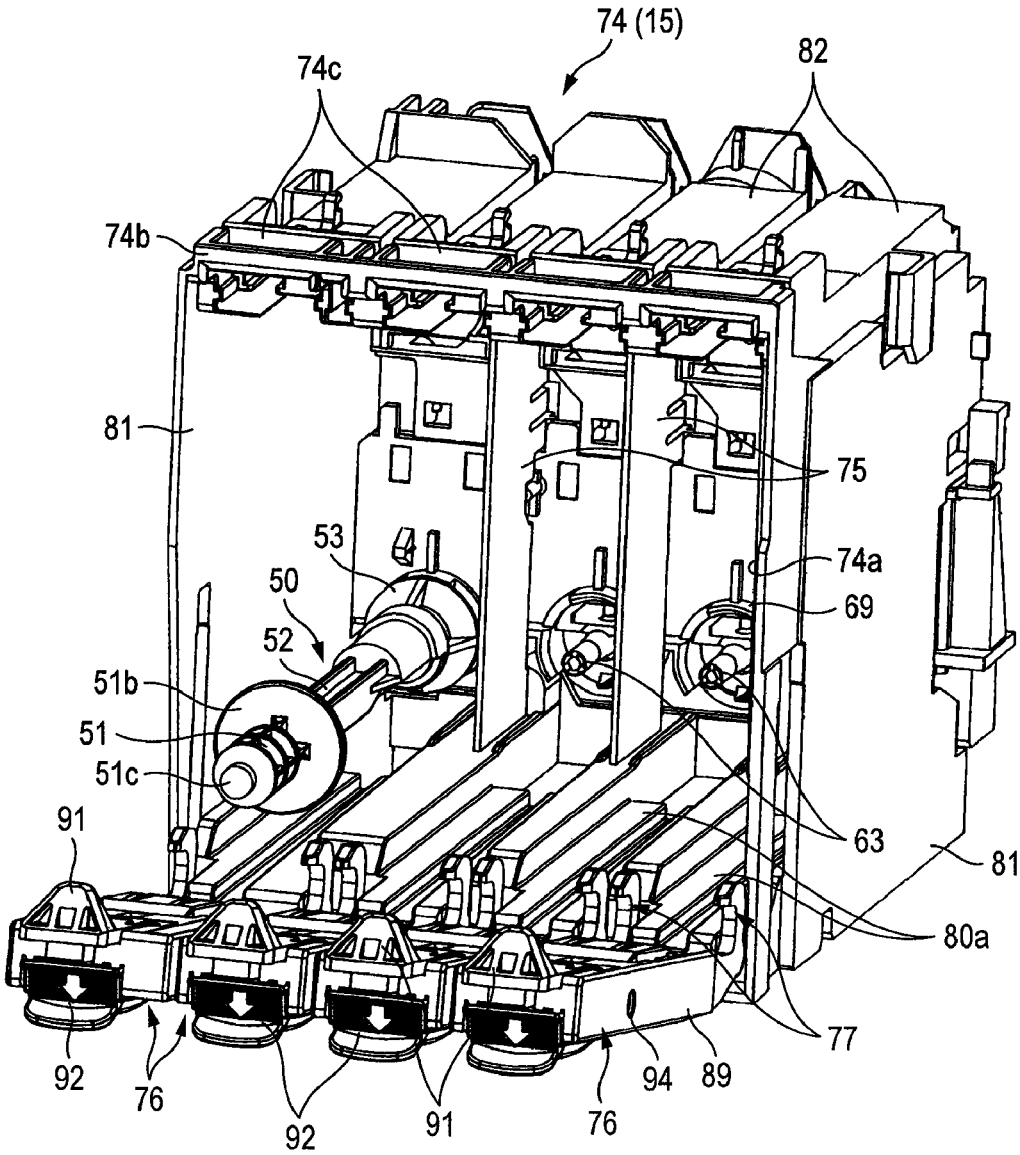
FIG. 15 is a perspective view showing a state where the protective cap unit of the another aspect is attached.
Figure 16A:
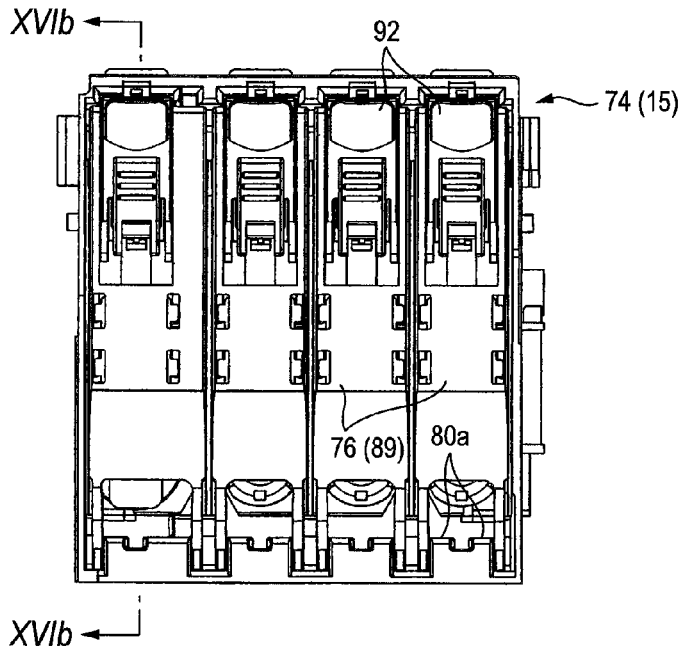
FIG. 16A is a front view of the cartridge container whose door body is closed.
Figure 16B:
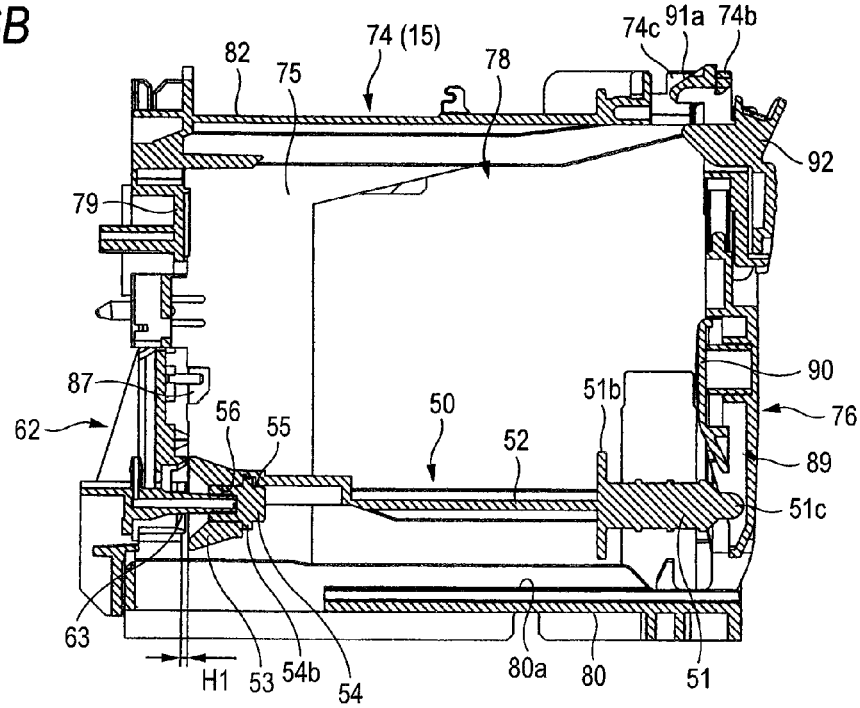
FIG. 16B is a cross-sectional view taken along the arrows XVIb-XVIb in FIG. 16A.

As shown in FIGS. 14C and 16B, a semi-annular groove 55 is formed at a connected portion (connection) between the supporting rod 52 and the guiding funnel 53. The semi-annular groove 55 is engaged with an approximately half circumferential part of the large-diameter collar portion 54*b* of the elastic cap 54. The fitting hole 56, into which the elastic cap 54 is insertable from the supporting rod 52 side, is provided at the inner diametrical portion of the guiding funnel 53. Therefore, even if the elastic cap 54 is pressed by the ink inlet 63 in the axial direction thereof at the time of the above-described sealing, the large-diameter collar portion 54*b* is engaged with the semi-annular groove 55. And therefore, the elastic cap 54 will not be disengaged from the connection between the supporting rod 52 and the guiding funnel 53. Further, in the case where the protective cap unit 50 is detached, even when an operator pulls out the protective cap unit 50 from the inside of the containing case body 74 by pinching only the main body 51 with fingers, the disadvantage that the elastic cap 54 is disengaged (comes off) from the inner diametrical portion of the guiding funnel 53 can be eliminated due to the large-diameter collar portion 54*b*.

The supporting rod 52 has a semicylindrical shape, and the fitting hole 56 of the connected portion (connection) between the supporting rod 52 and the guiding funnel 53 is formed to penetrate therethrough. Thus, even if the large-diameter collar portion 54*b* exists at the base end side, the elastic cap 54 can be easily inserted into and attached to the guiding funnel 53.

As shown in FIG. 16B, a gap having an appropriate dimension H1 is formed between a front end of the guiding funnel 53 or a substantially cone-shaped inner diametrical face thereof and a front edge of the guide rib 69, in a hermetically closed position (sealed position) in which the ink inlet 63 is inserted into the attachment concave portion 54*a* of the elastic cap 54. To this end, the diameter of the flared enlarged-side inner diametrical portion of the guiding funnel 53 is made larger than the outer circumferential diameter of the cylindrical guide rib 69, or the flared enlarged-side inner diametrical portion of the guiding funnel 53 is formed into a vertically elongated elliptical shape or oval shape with respect to the cylindrical guide rib 69, and is formed to be deviated upward with respect to the diametrical center of the guide rib 69.

By forming the gap as described above, ink attached to the guide rib 69 can be prevented from moving to the guiding funnel 53.

Furthermore, in aspects of the present invention, "different form" refers to a small form in which the overall shape of the protective cap unit 40 or 50 occupies only a part of a space of the accommodating chamber 78 serving as a cartridge containing part of the containing case body 74, and in particular refers to a form in which the shapes of the main body 41 (51) and the supporting rod 42 (52) are considerably smaller than (less than about half) the shape space of one ink cartridge 60 or a set of a plurality of the ink cartridges 60.

In an aspect of the present invention in which an opening is formed at an upper face of a containing case body of a cartridge container, and an ink inlet is upwardly opened at a bottom part of the containing case body, the protective cap unit 40 or 50 of aspects of the present invention may be inserted from above. Moreover, naturally, the present invention is not only applicable to the off-carriage type of the aspects, but also applicable to the on-carriage type.

What is claimed is:

1. A protector for an ink cartridge container, the ink cartridge container including a containing case body, an ink inlet for a recording head, a cartridge containing part into which an ink cartridge connectable to and disconnectable from the ink inlet is removably insertable, and a door body capable of opening and closing an opening opposed to the ink inlet with the cartridge containing part sandwiched therebetween, the protector comprising:

a protective cap unit that closes the ink inlet, the protective cap unit comprising:

a main body;

a supporting rod protruded toward the ink inlet from the main body;

a guiding funnel formed at a front edge of the supporting rod; and an elastic cap provided at an inner diametrical portion of the guiding funnel and capable of coming into close contact with the ink inlet, wherein the protective cap unit is removable from and insertable into a containing case body, and the protective cap unit is formed as a different shape than that of the ink cartridge, and wherein a position of the protective cap unit contained in the containing case body is maintained in a state where the elastic cap is brought into close contact with the ink inlet and the main body is pressed by the closed door body.

2. A protector for an ink cartridge container, the ink cartridge container including a containing case body, an ink inlet for a recording head, a cartridge containing part into which an ink cartridge connectable to and disconnectable from the ink inlet is removably insertable, and a door body capable of opening and closing an opening opposed to the ink inlet with the cartridge containing part sandwiched therebetween, the protector comprising:

a protective cap unit that closes the ink inlet, the protective cap unit comprising:

a main body;

a supporting rod protruded toward the ink inlet from the main body;

a guiding funnel formed at a front edge of the supporting rod; and an elastic cap provided at an inner diametrical portion of the guiding funnel and capable of coming into close contact with the ink inlet, wherein the protective cap unit is removable from and insertable into a containing case body, and the protective cap unit is formed as a different shape than that of the ink cartridge, wherein a plurality of the supporting rods and a plurality of the guiding funnels are provided in parallel, and wherein a number of the plurality of the supporting rods and the plurality of the guiding funnels correspond to a number of a plurality of ink inlets provided in the ink cartridge container.

3. A protector for an ink cartridge container, the ink cartridge container including a containing case body, an ink inlet for a recording head, a cartridge containing part into which an ink cartridge connectable to and disconnectable from the ink inlet is removably insertable, and a door body capable of opening and closing an opening opposed to the ink inlet with the cartridge containing part sandwiched therebetween, the protector comprising:

a protective cap unit that closes the ink inlet, the protective cap unit comprising:

a main body;

a supporting rod protruded toward the ink inlet from the main body;

a guiding funnel formed at a front edge of the supporting rod; and an elastic cap provided at an inner diametrical portion of the guiding funnel and capable of coming into close contact with the ink inlet, wherein the protective cap unit is removable from and insertable into a containing case body, and the protective cap unit is formed as a different shape than that of the ink cartridge, wherein the main body includes a restraining plate for restraining the elastic cap from being fitted to the ink inlet when the protective cap unit is inserted into the containing case body when the protective cap unit is in an improper position.

4. The protector according to claim 1, wherein the supporting rod of the protective cap unit is formed to be elastically deformable so as to be bent with respect to an axis thereof.

5. The protector according to claim 1, wherein the supporting rod, the guiding tunnel and the main body are integrally molded and are each formed into a thin shape using a flexible material.

6. The protector according to claim 1, wherein the elastic cap is removably inserted into and engaged with the inner diametrical portion of the guiding funnel only from a supporting rod side.

7. The protector according to claim 6, wherein an engaging groove, which is engaged with a collar portion formed at the elastic cap, is formed at a connection of the supporting rod with the guiding funnel.

8. The protector according to claim 1, wherein:

a gap is formed between the guiding funnel and a protective rib when a position of the protective cap unit is maintained in a state where the elastic cap is brought into close contact with the ink inlet and the main body is pressed by the closed door body.

* * * * *